US006641989B2

(12) United States Patent
Sasaki et al.

(10) Patent No.: US 6,641,989 B2
(45) Date of Patent: Nov. 4, 2003

(54) SILVER SALT PHOTOTHERMOGRAPHIC IMAGING MATERIAL

(75) Inventors: Takayuki Sasaki, Tokyo (JP); Akihisa Nakajima, Tokyo (JP); Tadashi Arimoto, Tokyo (JP); Kenji Ohnuma, Tokyo (JP); Yasuo Kurachi, Tokyo (JP); Eiichi Ueda, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/189,057

(22) Filed: Jul. 3, 2002

(65) Prior Publication Data

US 2003/0118958 A1 Jun. 26, 2003

(30) Foreign Application Priority Data

Jul. 11, 2001 (JP) ..... 2001/210771

(51) Int. Cl.[7] ..... G03C 1/498

(52) U.S. Cl. ..... 430/523; 430/527; 430/531; 430/533; 430/619; 430/950; 430/961

(58) Field of Search ..... 430/530, 531, 430/619, 533, 523, 637, 527, 961, 950

(56) References Cited

U.S. PATENT DOCUMENTS

| | | | | |
|---|---|---|---|---|
| 5,955,251 A | * | 9/1999 | Koyama et al. | 430/532 |
| 6,203,972 B1 | * | 3/2001 | Katoh et al. | 430/619 |
| 6,296,999 B1 | * | 10/2001 | Uyttendaele et al. | 430/617 |
| 6,383,729 B1 | * | 5/2002 | Ohnuma et al. | 430/533 |

* cited by examiner

*Primary Examiner*—Thorl Chea
(74) *Attorney, Agent, or Firm*—Frishauf, Holtz, Goodman & Chick, P.C.

(57) ABSTRACT

A silver salt photothermographic imaging material is disclosed, comprising a support provided thereon with a light sensitive layer containing an organic silver salt, a light sensitive silver halide, a reducing agent and a binder, wherein at least one side of the support is provided with a sublayer containing a metal oxide in an amount of 5 to 50% by volume and the surface of the sublayer exhibiting a maximum height ($R_y$) of not more than 0.1 $\mu$m.

13 Claims, 2 Drawing Sheets

SILVER SALT PHOTOTHERMOGRAPHIC IMAGING MATERIAL

FIELD OF THE INVENTION

The present invention relates to a silver salt photothermographic dry imaging material comprising a support provided thereon with a light sensitive layer containing an organic silver salt, a light sensitive silver halide, a reducing agent and a binder, and in particular to a silver salt photothermographic material characterized in a support having an improved sublayer.

BACKGROUND OF THE INVENTION

In the field of graphic arts and medical treatment, there have been concerns in processing of photographic film with respect to effluent produced from wet-processing of image forming materials, and recently, reduction of the processing effluent is strongly demanded in terms of environmental protection and space savings. There has been desired a photothermographic dry imaging material for photographic use, capable of forming distinct black images exhibiting high sharpness, enabling efficient exposure by means of a laser imager or a laser image setter. Known as such a technique are thermally developable silver salt photographic materials (which are the same as photothermographic materials, as described in the present invention) comprising on a support an organic silver salt, light-sensitive silver halide and a reducing agent, as described in D. Morgan and B. Shely, U.S. Pat. Nos. 3,152,904 and 3,487,075, and D. H. Klosterboer, "Thermally Processed Silver Systems" in IMAGING PROCESSES and MATERIALS, Neblette's Eighth Edition, edited by J. M. Sturge, V. Walworth, and A. Shepp (1969) page 279. The thermally developable silver salt photographic material provides a simply and environment-friendly system for users, without use of any processing solution.

These silver salt photothermographic materials are provided on a support with a light sensitive layer containing light sensitive silver halide grains as a photosensor and an organic silver salt as a silver ion source, which are thermally developed with an included reducing agent usually at a temperature of 80 to 140° C. to form images, and a backing layer containing a dye to absorb laser light. These layers must be strongly adhered to the support not only before but also after subjected to thermal development. Silver halide photographic materials, in general, are provided a sublayer to allow the light sensitive layer, backing layer or an interlayer to be adhered to the support.

Even in silver salt photothermographic imaging materials, it is also effective to provide a sublayer to allow such layers to be adhered, however, it is necessary for design of the silver salt photothermographic materials to take into consideration inherent to the photothermographic materials and differing from conventional photographic materials which are processed with a developer solution. Specifically, comparing to conventional processing with a developer solution, heating at 80 to 140° C. is applied at the time of thermal development, easily causing internal stress and it therefore needs to make design different from that of conventional sublayers.

Further, insufficient adhesion after subjected to thermal development often produces troubles such as abrasion mark. Even in silver salt photothermographic materials, an antistatic action is needed and a sublayer provided with electric conductivity is needed to prevent troubles specifically caused in an exposure and processing system. The sublayer functions as an adhesion promotion layer, while it needs fastness until the light sensitive layer and backing layer are coated thereon. However, it was difficult to satisfy both demands.

SUMMARY OF THE INVENTION

Furthermore, it is an object of the invention to provide a silver salt photothermographic material exhibiting superior resistance to abrasion marks even after subjected to thermal processing, and improved working resistance during the manufacturing process and storage stability.

The foregoing object can be accomplished by the following constitution:

A silver salt photothermographic imaging material comprising a support provided thereon with a light sensitive layer containing an organic silver salt, a light sensitive silver halide, a reducing agent and a binder, wherein the support has at least one sublayer on at least one side of the support, the sublayer containing a metal oxide in an amount of 5 to 50% by volume and the surface of the sublayer having a maximum height ($R_y$) of not more than 0.1 $\mu$m.

It is preferred that the sublayer comprises at least two layers comprised of upper and lower layers, the lower layer containing an acryl copolymer; and the lower layer preferably contains a polymer having an oxazoline group.

DETAILED DESCRIPTION OF THE INVENTION

Figure 1:
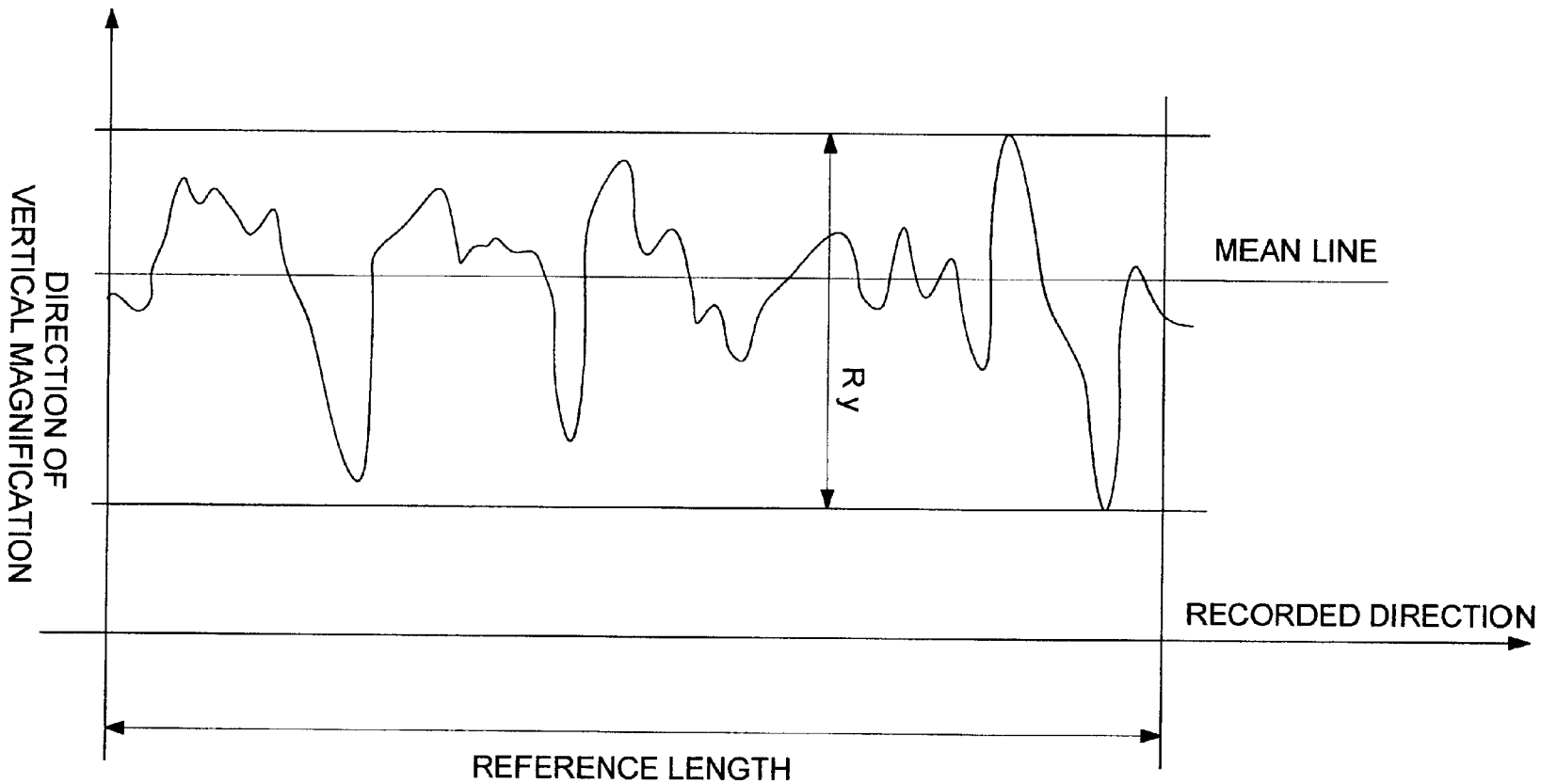
FIG. 1 illustrates an example of determination of the maximum height ($R_y$) of the surface relating to the invention.

Materials used for supports of silver salt photothermographic imaging materials relating to the invention include, for example, various polymeric materials, glass, wool cloth, cotton cloth, paper and metals such as aluminum. Specifically, flexible sheets or supports convertible to a roll form are preferable. There are preferably employed plastic resin films (e.g., cellulose acetate film, polyester film, polyethylene terephthalate film, polyethylene naphthalate film, polyamide film, polyimide film, cellulose triacetate film and polycarbonate film). In cases where the photothermographic material relating to the invention is employed for medical use, a support relating to the invention is preferably a blue, biaxially stretched and thermally fixed polyethylene terephthalate film with a thickness of 70 to 180 $\mu$m. There can be employed techniques described in JP-A No. 2001-22026, at paragraph Nos. [0030] through [0034] (hereinafter, the term, JP-A is referred to as Japanese Patent Application Publication). Support used in the invention are preferably subjected to corona discharge. The discharging condition is preferably 5 to 30 W/m$^2$. It is preferred that the support having been subjected to a corona discharge treatment is coated with a sublayer relating to the invention within one to two months after completion of the corona discharge treatment.

The supports relating to the invention can be subjected to a plasma surface treatment and preferably to a plasma surface treatment in the vicinity of atmospheric pressure. As surface-treating gas for use in the plasma surface treatment is preferably a gas capable of providing a polar functional group, such as an amino group, carboxyl group, hydroxy group or carbonyl group. Examples thereof include nitrogen gas ($N_2$), hydrogen gas ($H_2$), oxygen gas ($O_2$), carbon dioxide gas ($CO_2$), ammonia gas ($NH_3$) and water vapor. In addition to such a reactive gas, an inert gas such as helium or argon is also needed and the inert gas proportion of not less than 60% results in stable discharging conditions. However, in cases when plasma is produced under the pulsed electric field, inert gas is not necessarily needed, enabling a reactive gas concentration to be increased. A frequency of the pulsed electric field is preferably within the range of 1 to 100 kHz. The time for applying the pulsed electric field is preferably 1 to 1,000 $\mu$s, and a magnitude of the voltage applied to an electrode is preferably within an electric field strength of 1 to 100 kV/cm.

Organic silver salts usable in the photothermographic material (hereinafter, also denoted simply as a silver salt relating to the invention) are a reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (e.g., salts of gallic acid, oxalic acid, behenic acid, stearic acid, palmitic acid, lauric acid, etc.). Other examples include organic silver salts described in JP-A No. 2001-83659 at paragraph [0193]. With respect to a preparation method of organic silver salts and grain sizes of the organic silver salt are referred the same publication at paragraph [0194] through [0197]. Technique described in JP-A No. 2001-48902, paragraph [0028] through [0033]; and JP-A No. 2001-72777, paragraph [0025] through [0041] are applicable to organic silver salts relating to the invention.

Light-sensitive silver halide grains used in the invention are referred to as those which can absorb visible or infrared light as an inherent property of silver halide crystal through the artificial or physicochemical process and can cause physicochemical change, upon absorption of visible or infrared light, in the interior and/or on the surface of the silver halide crystal.

The silver halide grains used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Specifically, preparation of silver halide grains with controlling the grain formation condition, so-called controlled double-jet precipitation is preferred. The halide composition of silver halide is not specifically limited and may be any one of silver chloride, silver chlorobromide, silver iodochlorobromide, silver bromide, silver iodobromide and silver iodide. The grain forming process is usually classified into two stages of formation of silver halide seed crystal grains (nucleation) and grain growth. These stages may continuously be conducted, or the nucleation (seed grain formation) and grain growth may be separately performed. There is also employed a technique described in JP-A No. 2001-83659, paragraph [0063].

In order to minimize cloudiness after image formation and to obtain excellent image quality, the less the average grain size, the more preferred, and the average grain size is preferably not more than 0.2 $\mu$m, more preferably between 0.01 and 0.17 $\mu$m, and still more preferably between 0.02 and 0.14 $\mu$m. The average grain size as described herein is defined as an average edge length of silver halide grains, in cases where they are so-called regular crystals in the form of cube or octahedron. Furthermore, in cases where grains are tabular grains, the grain size refers to the diameter of a circle having the same area as the projected area of the major faces.

Furthermore, silver halide grains are preferably monodisperse grains and techniques detailed in JP-A 2001-83659, paragraph [0064] through [0066] are applicable. The grain form can be of almost any one, including cubic, octahedral or tetradecahedral grains, tabular grains, spherical grains, bar-like grains, and potato-shaped grains. Of these, cubic grains, octahedral grains, tetradecahedral grains and tabular grains are specifically preferred. The aspect ratio of tabular grains is preferably 1.5 to 100, and more preferably 2 to 50. These grains are described in U.S. Pat. Nos. 5,264,337, 5,314,798 and 5,320,958 and desired tabular grains can be readily obtained. Techniques described in JP-A 2001-83659, paragraph [0068] through [0090] are also applicable as a grain formation technique.

It is preferred that light a sensitive silver halide relating to the invention contains transition metal ions selected from groups 6 through 11 of the periodical table to improve reciprocity law failure of intensity. The metal ions are contained preferably in an amount of $1\times10^{-9}$ to $1\times10^{-2}$ mol, and more preferably $1\times10^{-8}$ to $1\times10^{-4}$ mol per mol of silver. A preferred transition metal complex or complex ion is represented by the following general formula:

$$[ML_6]^m$$

where M is a transition metal ion selected from elements in Groups 6 through 11 of the periodical table, L is a ligand; and m is 0, 1-, 2-, 3- or 4-. Examples of the ligand represented by L include halide ions (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. There are used transition metal complex ions described in JP-A No. 2001-83659, paragraph [0094] through [0095].

Light sensitive silver halide relating to the invention is preferably subjected to chemical sensitization. With regard to preferred chemical sensitization are employed chemical sensitizers and techniques described in JP-A No. 2000-112057, paragraph [0044] to [0045].

The light sensitive silver halide relating to the invention preferably is spectrally sensitized. With regard to preferred spectral sensitization can be employed sensitizing dyes and techniques described in JP-A No. 2001-83659, paragraph [0099] through [0144]. In the light sensitive silver halide, a dye which has no its own spectral sensitization action or material which substantially has no absorption in the visible light region may be used as a supersensitizer, together with the sensitizing dye. There can be employed compounds, as a supersensitizer, described in JP-A No. 2001-83659, paragraph [0148] through [0152]. Besides the foregoing supersensitizers, macrocyclic compounds containing at least one heteroatom, represented by general formula (1)

described in Japanese Patent Application No. 12-070296 can also be used as a supersensitizer. Examples of the compounds represented by the formula (1) are shown in Japanese Patent Application No. 12-070296, paragraph [0034] through [0039]. The heteroatom containing macrocyclic compound is also described in Japanese Patent Application No. 12-070296, paragraph [0044] through [0054].

Reducing agents usable in the silver salt photothermographic material of the invention (hereinafter, also denoted simply as reducing agents relating to the invention) are optimally selected from reducing agents commonly known in the art of silver salt photothermographic imaging materials. In cases where fatty acid silver salts are used as an organic silver salt are preferred polyphenols in which at least two phenyl groups are linked through an alkylene group or a sulfur atom and specifically, bisphenols in which two phenyl groups which are substituted, at the position adjacent to the hydroxy group-substituted position, with at least an alkyl group (e.g., methyl, ethyl, propyl, t-butyl, cyclohexyl, etc.) or an acyl group (e.g., acetyl, propionyl, etc.) are linked through an alkylene group or a sulfur atom. Hindered phenol type reducing agents, described in JP-A No. 2000-112057, paragraph [0047] to [0048] are preferably used in the invention. Exemplary compounds thereof are described in JP-A No. 2000-112057, paragraph [0050] to [0051]. The reducing agent is used in an amount of $1\times10^{-2}$ to 10 mol, and preferably $1\times10^{-2}$ to 1.5 mol per mol of silver.

Binders usable in the silver salt photothermographic material of the invention (hereinafter, also denoted simply as binders relating to the invention) may be transparent or translucent and is generally non-color, which are natural polymers or synthetic polymers. Examples of binders relating to the invention include natural or synthetic polymers described in JP-A No. 2001-66725, paragraph [0193]. The binder relating to the invention preferably is polyvinyl acetals and more preferably polyvinyl butyral. The binder is usually used in a ratio of binder: organic silver salt of 15:1 to 1:2, and preferably 8:1 to 1:1. Polymer latexes are also preferably used as a binder of the invention. Compounds and techniques described in JP-A 2001-66725, paragraph [0194] to [0203] are applicable to the polymer latexes.

The use of cross-linking agents in the binder relating to the invention is expected to effectively reduce development unevenness and prevent fogging during storage and printed-out silver formation after development. Aldehyde type, epoxy type, ethyleneimine type, vinylsulfon type, sulfonic acid ester type, acryloyl type, carbodiimide type and silane compound type cross-linking agents, as described in JP-A No. 50-96216, can be employed and of these, isocyanate type compounds, silane compounds, epoxy compounds and acid anhydrides are preferred. With regard the isocyanate type compounds are applicable compounds and techniques described in JP-A No. 2001-83659, paragraph [0159] through [0168]; with regard the epoxy compounds are applicable compounds and techniques described in JP-A No. 2001-83659, paragraph [0170] through [0180]; with regard the acid anhydrides are applicable compounds and techniques described in JP-A No. 2001-83659, paragraph [0182] through [0187]; and with regard the silane compounds are applicable compounds and techniques described in JP-A No. 12-77904, paragraph [0022] through [0028].

There can be optionally employed image toning agents in silver salt photothermographic imaging materials. Compounds and techniques described in JP-A 2000-198757, paragraph [0064] through [0066] are applicable to image toning agents usable in the invention.

In order to control an amount or wavelength distribution of light transmitted through a light sensitive layer of the silver salt photothermographic material, it is preferred to provide a filter layer on the same side as or the opposite side to the light sensitive layer or to incorporate a dye or a pigment into the light sensitive layer. Commonly known compounds capable of absorbing light at various wavelengths in accordance with spectral sensitivity of photothermographic materials can be employed as a dye used in the invention. To conduct image-recording with an infrared light using the photothermographic material of the invention, for example, squalelium dyes containing thiopyrylium nucleus and squalelium dyes containing squalilium nucleus are preferably employed, as described in JP-A No. 2001-083655. There are also usable croconium dyes containing a thiopyrylium nucleus and croconium dyes containing a pyrylium nucleus, which are similar to the squalelium dyes.

As a reducing agent used in the photothermographic material of the invention are often employed reducing agents containing a proton, such as bisphenols and sulfonamidophenols. Accordingly, a compound generating a labile species which is capable of abstracting a proton to deactivate the reducing agent is preferred. More preferred is a compound as a non-colored photo-oxidizing substance, which is capable of generating a free radical as a labile species on exposure. Examples thereof include biimidazolyl compounds described in JP-A No. 2001-249428, paragraph [0065] through [0069] and iodonium compounds described in JP-A No. 2001-249428, paragraph [0071] through [0082].

As a compound capable of deactivating a reducing agent to inhibit reduction of an organic silver salt to silver by the reducing agent are also employed compounds releasing a a halogen atom as a labile species. Examples thereof include compounds described in JP-A No. 2001-249428, paragraph [0086] through [0102].

There can be employed a silver-saving agent in the photothermographic material of the invention. The silver-saving agent used in the invention refers to a compound capable of reducing the silver amount necessary to obtain a prescribed silver density. The action mechanism for the reducing function has been variously supposed and compounds having a function of enhancing covering power of developed silver are preferred. Herein the covering power of developed silver refers to an optical density per unit amount of silver. Examples thereof include hydrazine derivatives described in Japanese Patent Application No. 11-238293, paragraph [0075] through [0081]; vinyl compounds described in Japanese Patent Application No. 11-238293, paragraph [0109] through [0132]; and quaternary onium compounds described in Japanese Patent Application No. 11-238293, paragraph [0150] through [0158].

The silver salt photothermographic material of the invention is provided, on a support having a sublayer, with a light sensitive layer containing an organic silver salt, light sensitive silver halide, a reducing agent and a binder; and it is preferable to provide a light insensitive layer on the light sensitive layer. For example, it is preferred that a protective layer is provided on the light sensitive layer to protect the light sensitive layer, and a backing layer is provided on the opposite side of the support to prevent self-adhesion. Binders used in such a protective layer and backing layer are a polymer which exhibits a glass transition point higher than those used in the light sensitive layer and does not easily cause an abrasion mark or deformation, such as cellulose acetate and cellulose acetate butyrate, as selected from the foregoing polymers. There may be provided at least two light sensitive layers on one side of the support or at least one light sensitive layer on both sides of the support to control tone.

In the silver salt photothermographic material, it is preferred that a coating solution is prepared by dissolving or dispersing material to be used in each of the foregoing component layers in a solvent and plural coating solutions are simultaneously coated, followed by a heating treatment to form the respective layers. Herein, expression "plural coating solution are simultaneously coated" means that coating solutions for the respective component layers are prepared and simultaneously coated and dried to form the component layers, instead of repeating coating and drying for each of the component layers. Specifically, it is preferred to provide an upper layer on a lower layer before a residual solvent content of the lower layer reaches 70% by weight or less. Methods for simultaneously coating plural constituent layers are not specifically limited and commonly known methods, such as a bar coating method, curtain coating method, air-knife method, hopper coating method and extrusion coating method are applicable. Of these, extrusion coating, that is, pre-measuring type coating is preferred. The extrusion coating is suitable for accurate coating or organic solvent coating since no evaporation occur on the slide surface, as in a slide coating system. This coating method is applicable not only to the light-sensitive layer side but also to the case when simultaneously coating a backing layer with the sublayer. Alternatively, the photothermographic material of the invention may be coated using an aqueous solvent.

The developing conditions for photographic materials are variable, depending on the instruments or apparatuses used, or the applied means and typically accompany heating the imagewise exposed photothermographic imaging material at an optimal high temperature. Latent images formed upon exposure are developed by heating the photothermographic material at an intermediate high temperature (ca. 80 to 200° C., and preferably 100 to 200° C.) over a period of sufficient time (generally, ca. 1 sec. to ca. 2 min). Sufficiently high image densities cannot be obtained at a temperature lower than 80° C. and at a temperature higher than 200° C., the binder melts and is transferred onto the rollers, adversely affecting not only images but also transportability or the thermal processor. An oxidation reduction reaction between an organic silver salt (functioning as an oxidant) and a reducing agent is caused upon heating to form silver images. The reaction process proceeds without supplying any processing solution such as water from the exterior. Heating instruments, apparatuses and means include typical heating means such as a hot plate, hot iron, hot roller or a heat generator employing carbon or white titanium. In the case of a photothermographic imaging material provided with a protective layer, it is preferred to thermally process while bringing the protective layer side into contact with a heating means, in terms of homogeneous-heating, heat efficiency and working property. It is preferred to conduct transport with bringing the layer side into contact with a heat roller to perform thermal development.

It is preferred that when subjected to thermal development, the photothermographic imaging material contains an organic solvent of 5 to 1000 mg/m$^2$. The organic solvent content is more preferably 100 to 500 mg/M$^2$. The solvent content within the range described above leads to a thermally developable photosensitive material with low fog density as well as high sensitivity. Examples of solvents include ketones such as acetone, isophorone, ethyl amyl ketone, methyl ethyl ketone, methyl isobutyl ketone; alcohols such as methyl alcohol, ethyl alcohol, n-propyl alcohol, isopropyl alcohol, n-butyl alcohol, isobutyl alcohol, diacetone alcohol, cyclohexanol, and benzyl alcohol; glycols such as ethylene glycol, diethylene glycol, triethylene glycol, propylene glycol and hexylene glycol; ether alcohols such as ethylene glycol monomethyl ether, and diethylene glycol monomethyl ether; ethers such as ethyl ether, dioxane, and isopropyl ether; esters such as ethyl acetate, butyl acetate, amyl acetate, and isopropyl acetate; hydrocarbons such as n-pentane, n-hexane, n-heptane, cyclohexene, benzene, toluene, xylene; chlorinated compounds such as chloromethyl, chloromethylene, chloroform, and dichlorobenzene; amines such as monomethylamine, dimethylamine, triethanol amine, ethylenediamine, and triethylamine; and water, formaldehyde, dimethylformaldehyde, nitromethane, pyridine, toluidine, tetrahydrofuran and acetic acid. The solvents are not to be construed as limiting these examples. These solvents may be used alone or in combination. The solvent content in the photothermographic material can be adjusted by varying conditions such as temperature conditions at the drying stage, following the coating stage. The solvent content can be determined by means of gas chromatography under conditions suitable for detecting the solvent.

Next, exposure conditions for the silver salt photothermographic material of the invention will be described. Exposure of photothermographic imaging materials desirably uses a light source suitable to the spectral sensitivity of the photothermographic materials. An infrared-sensitive photothermographic material, for example, is applicable to any light source in the infrared light region but the use of an infrared semiconductor laser (780 nm, 820 nm) is preferred in terms of being relatively high power and transparent to the photothermographic material.

In the invention, exposure is preferably conducted by laser scanning exposure and various methods are applicable to its exposure.

One of the preferred embodiments is the use of a laser scanning exposure apparatus, in which scanning laser light is not exposed at an angle substantially vertical to the exposed surface of the photothermographic material. The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°. When the photothermographic material is scanned with laser light, the beam spot diameter on the surface of the photosensitive material is preferably not more than 200 $\mu$m, and more preferably not more than 100 $\mu$m. Thus, the smaller spot diameter preferably reduces the angle displaced from verticality of the laser incident angle. The lower limit of the beam spot diameter is 10 $\mu$m. The thus configured laser scanning exposure can reduce deterioration in image quality due to reflected light, such as occurrence of interference fringe-like unevenness.

In the second preferred embodiment of the invention, exposure applicable in the invention is conducted preferably using a laser scanning exposure apparatus producing longitudinally multiple scanning laser light, whereby deterioration in image quality such as occurrence of interference fringe-like unevenness is reduced, as compared to scanning laser light with longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but is usually about 60 nm.

In the third preferred embodiment of the invention, it is preferred to form images by scanning exposure using at least two laser beams. The image recording method using such plural laser beams is a technique used in image-writing means of a laser printer or a digital copying machine for writing images with plural lines in a single scanning to meet requirements for higher definition and higher speed, as described in JP-A 60-166916. This is a method in which laser light emitted from a light source unit is deflection-scanned with a polygon mirror and an image is formed on the photoreceptor through an fθ lens, and a laser scanning optical apparatus similar in principle to an laser imager. In the image-writing means of laser printers and digital copying machines, image formation with laser light on the photoreceptor is conducted in such a manner that displacing one line from the image forming position of the first laser light, the second laser light forms an image from the desire of writing images with plural lines in a single scanning. Concretely, two laser light beams are close to each other at a spacing of an order of some ten μm in the sub-scanning direction on the image surface; and the pitch of the two beams in the sub-scanning direction is 63.5 μm at a printing density of 400 dpi and 42.3 μm at 600 dpi (in which the printing density is represented by "dpi", i.e., the number of dots per inch). As is distinct from such a method of displacing one resolution in the sub-scanning direction, one feature of the invention is that at least two laser beams are converged on the exposed surface at different incident angles to form images. In this case, when exposed with N laser beams, the following requirement is preferably met: when the exposure energy of a single laser beam (of a wavelength of λ nm) is represented by E, writing with N laser beam preferably meets the following requirement:

$$0.9\times E \leqq En\times N \leqq 1.1\times E$$

in which E is the exposure energy of a laser beam of a wavelength of λ nm on the exposed surface when the laser beam is singly exposed, and N laser beams each are assumed to have an identical wavelength and an identical exposure energy (En). Thereby, the exposure energy on the exposed surface can be obtained and reflection of each laser light onto the image forming layer is reduced, minimizing occurrence of an interference fringe. In the foregoing, plural laser beams having a single wavelength are employed but lasers having different wavelengths may also be employed. In such a case, the wavelengths preferably fall within the following range:

$$(\lambda-30)<\lambda_1, \lambda_2, \ldots \lambda_n<(\lambda+30).$$

In the first, second and third preferred embodiments of the image recording method of the invention, lasers for scanning exposure used in the invention include, for example, solid-state lasers such as ruby laser, YAG laser, and glass laser; gas lasers such as He-Ne laser, Ar laser, Kr ion laser, $CO_2$ laser, Co laser, He-Cd laser, $N_2$ laser and excimer laser; semiconductor lasers such as InGa laser, AlGaAs laser, GaAsP laser, InGaAs laser, InAsP laser, $CdSnP_2$ laser, and GaSb laser; chemical lasers; and dye lasers. Of these, semiconductor lasers of wavelengths of 600 to 1200 nm are preferred in terms of maintenance and the size of the light source. When exposed onto the photothermographic imaging material in the laser imager or laser image-setter, the beam spot diameter on the exposed surface is 5 to 75 μm as a minor axis diameter and 5 to 100 μm as a major axis diameter. The laser scanning speed is set optimally for each photothermographic material, according to its sensitivity at the laser oscillation wavelength and the laser power.

Next, the present invention will be further detailed.

One aspect of the invention is that at least one side of the support relating to the invention is provided with a first sublayer containing a metal oxide in an amount of 5 to 50% by volume and a maximum height on the surface of the sublayer is not more than 0.1 μm.

The maximum height (hereinafter, also denoted as $R_y$) is known in the art, which is a parameter to assess roughness of the surface and is defined in accordance with JIS B 0601 (Definitions and Designation of Surface Roughness), Sect. 4. Definition and Designation of Maximum Height ($R_y$). The JIS B 0601 also corresponds to ISO 468-1982, ISO 3274-1975, ISO 4287/1-1984, ISO 4287/2-1984 and ISO 4288-1985. The maximum height of the surface is determined as follows. Thus, when a length corresponding to the reference length in the direction of a mean line is sampled from a roughness profile, the maximum height ($R_y$) is a value, expressed in micrometer (μm) measuring the space between a peak line and a valley line in the direction of vertical magnification of the profile. FIG. 1 shows a surface roughness profile and the determination of the maximum height ($R_y$).

In the invention, it is important to satisfy the requirement that the sublayer contains a proper content of a metal oxide and exhibits a proper maximum height ($R_y$). Herein, the content of a metal oxide is represented in terms of percentage by volume, based on the sublayer. For example, even when the metal oxide is contained in a proper amount but when the maximum height ($R_y$) exceeds 0.1 μm, abrasion marks are produced in roll transportation or after processing the photothermographic material. Alternatively, even when the maximum height ($R_y$) is not more than 0.1 μm but when a content of the metal oxide falls outside of the range of 5% to 50% by volume of the sublayer, abrasion marks are produced in roll transportation or after processing the photothermographic material. In the invention, the maximum height ($R_y$) is not more than 0.1 and preferably 0.001 to 0.1 μm. To adjust the maximum height ($R_y$) to not more than 0.1 μm, it is preferred to meet the following relationship:

$$rd-hd \leqq 0.1\ \mu m$$

wherein hd is a dry layer thickness of the sublayer, expressed in μm, and rd is a particle diameter, expressed in μm of the metal oxide (or in cases when inorganic particles are contained, rd is an inorganic particle diameter, expressed in μm). Further, it is important to conduct sufficient leveling in the wet state at the time of coating the sublayer.

Metal oxides used in the invention are preferably those exhibiting electric conductivity, including particles of a metal oxide which easily forms a nonstoichiometric compound, such as an oxygen-deficient oxide, metal-excess oxide, metal-deficient oxide and oxygen-excess oxide. Of these are specifically preferred fine particles of a metal oxide which can be prepared in various manners. Crystalline metal oxides are popular as a metal oxide, and examples thereof include ZnO, $TiO_2$, $SnO_2$, $Al_2O_3$, $In_2O_3$, $SiO_2$, MgO, $B_2$, $MoO_3$, and compound oxides thereof. Of these oxides, ZnO, $TiO_2$ and $SnO_2$ are preferred and their compound oxides are preferably those containing dissimilar element(s) in an amount of 0.01 to 30 mol %, and more preferably 0.1 to 10 mol %. Examples thereof include ZnO containing a dissimilar element such as Al or In, $TiO_2$ containing a dissimilar element such as Nb or Ta, and $SnO_2$ containing a dissimilar element such as Sb, Nb or halogen elements.

A volume resistance of the metal oxide particles used in the invention is preferably not more than $10^7$ Ω·cm, and more preferably not more than $10^5$ Ω·cm. Specifically, a metal oxide containing an oxygen defect in the interior of its crystal or containing a small amount of a heteroatom as a so-called donor, whereby conductivity is enhanced, is preferred. A preparation method of such metal oxide particles is detailed, for example, in JP-A 56-143430.

The metal oxide particles enhance electric conductivity and it is necessary to take into account the particle size and the particle/binder ratio in view of light scattering. Thus, it is preferred to use an inorganic colloid, which is present in a colloidal form in water, in terms of deterioration due to haze and difficulty in dispersing. The inorganic colloid refers to one containing $10^5$ to $10^9$ atoms per particle, as is defined in "ENCYCLOPAEDIA CHIMICA", published by Kyoritsu-Shuppan. Such an inorganic colloid is obtained as a metal colloid, oxide colloid or hydroxide colloid. A metal colloid of gold, palladium, platinum, silver or sulfur is preferably used, and an oxide colloid, hydroxide colloid, carbonate colloid and sulfate colloid of zinc, magnesium, silicon, calcium, aluminum, strontium, barium, zirconium, titanium, manganese, iron, cobalt, nickel, tin, indium, molybdenum, or vanadium are preferable in the invention. Specifically, ZnO, $TiO_2$ and $SnO_2$ are preferred and $SnO_2$ is more preferred. Furthermore, examples of the foregoing heteroatom-doped metal oxide include ZnO doped with Al or In, $TiO_2$ doped with Nb or Ta, and $SnO_2$ doped with Sb, Nb or a halogen element. The average size of the inorganic colloid particles is preferably 0.001 to 1 $\mu$m in terms of dispersion stability.

Metal oxide colloids used in the invention, specifically colloidal $SnO_2$ sol comprised of tin(IV) oxide can be prepared by dispersing ultra-fine $SnO_2$ particles in an appropriate solvent or through a decomposition reaction of a solvent-soluble tin compound (hereinafter, also denoted as Sn compound) in the solvent. In the preparation of the ultra-fine $SnO_2$ particles is important the temperature condition. A method accompanied by a heat treatment at a relatively high temperature is not preferable, resulting in growth of primary particles or increased crystallinity. In cases when the heat treatment is needed, the temperature is 300° C. or less, preferably 200° C., and more preferably 150° C. or less. Heating from 25° C. to 150° C. is a suitably selected means in terms of dispersion in a binder. Next, the preparation through a decomposition reaction of a solvent-soluble Sn compound in the solvent will be described. The solvent-soluble compound means a compound containing an oxoanion such as $K_2SnO_3 \cdot 3H_2O$, water-soluble halide compound such as $SnCl_4$ or a compound having a structure represented by $R'_2SnR_2$, $R_3SnX$ or $R_2SnX_2$ (in which R and R' represent an alkyl group), including, for example, organometallic compound such as $(CH_3)_3SnCl \cdot$(pyridine), $(C_4H_9)_2Sn(O_2CC_2H_5)_2$ and an oxo-salt such as $Sn(SO_4)_2 \cdot 2H_2O$. Methods for preparing a $SnO_2$ sol using the solvent-soluble Sn compound include a physical method by dissolving in a solvent, followed by applying heat or pressure, chemical method by oxidation, reduction or hydrolysis, and a method of preparing a $SnO_2$ sol via an intermediate. Alternatively, a $SnO_2$ sol preparation method described in JP-B No. 35-6616 is applicable to the metal oxide relating to the invention (hereinafter, the term, JP-B means a Japanese Patent Publication).

In the invention, it is preferred to provide a layer containing an acryl copolymer between the foregoing sublayer and the support, i.e., as a lower sublayer (hereinafter, this layer is also denoted as a lower sublayer). The acryl copolymer is preferably a copolymer containing at least 20 mol % of an alkyl acrylate or alkyl methacrylate. A copolymerizing component is preferably selected from the group of styrene, styrene derivatives, olefin derivatives, halogenated ethylene derivatives, vinyl ester derivatives, and acrylonitrile. A water-dispersed latex containing 10 to 25 mol % of the acryl copolymer, i.e., acryl copolymer latex is specifically preferred.

It is also preferred to provide a layer containing a polymer having an oxazoline group between the foregoing sublayer and the support, as a lower sublayer. Such an oxazoline group having polymer preferably is a water-soluble polymer having an oxazoline group, as a pendant, represented by the following formula (A):

formula (A)

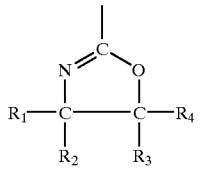

wherein $R_1$, $R_2$, $R_3$ and $R_4$ are independently a hydrogen atom, a halogen atom, an alkyl group, aralkyl group, or a phenyl or substituted phenyl group, and are preferably a hydrogen atom or a lower alkyl group. Exemplary examples thereof are as follows.

| | $R_1$ | $R_2$ | $R_3$ | $R_4$ |
|---|---|---|---|---|
| 1 | Hydrogen | Hydrogen | Hydrogen | Hydrogen |
| 2 | Methyl | Hydrogen | Hydrogen | Hydrogen |
| 3 | Hydrogen | Hydrogen | Methyl | Hydrogen |
| 4 | Hydrogen | Hydrogen | Ethyl | Hydrogen |
| 5 | i-Propyl | Hydrogen | Hydrogen | Hydrogen |
| 6 | Chlorine | Hydrogen | Hydrogen | Hydrogen |
| 7 | Chlorine | Chlorine | Hydrogen | Hydrogen |
| 8 | Chlorine | Hydrogen | Chlorine | Hydrogen |

The water-soluble polymers having 2-oxazoline group for example, polymer (B) described in JP-A No. 5-295275. Concretely, the water-soluble polymer can be synthesized by polymerization of a monomer containing 2-oxazoline group, such as 2-vinyl-2-oxazoline, 2-vinyl-4-methyl-2-oxazoline, 2-vinyl-5-methyl-2-oxazoline, 2-isopropenyl-2-oxazoline, 2-isopropenyl-4-methyl-2-oxazoline and 2-isopropenyl-5-ethyl-2-oxazoline, optionally together with at least one of other monomers, in accordance with a commonly known method to perform solution polymerization in an aqueous medium.

The amount of the monomer containing 2-oxazoline group to be used is not specifically limited and at least 3% by weight of constituent monomers is preferably accounted for by the monomer containing 2-oxazoline group, and 5 to 100% by weight is more preferable.

Examples of other monomers include acrylates or methacrylates such as methyl acrylate, ethyl acrylate, n- or i-propyl acrylate, n-, i- or t-butyl acrylate, 2-hydroxyethyl acrylate, cyclohexyl acrylate, benzyl acrylate, ethylene glycol diacrylate, propylene glycol diacrylate, polyethylene glycol acrylate, α-chloro-methyl acrylate, α-chloro-ethyl acrylate, methyl methacrylate, ethyl methacrylate, n- or i- or t-butyl methacrylate, 2-hydroxyethyl methacrylate, cyclohexyl methacrylate, benzyl methacrylate, ethylene glycol dimethacrylate, propylene glycol dimethacrylate, and polyethylene glycol methacrylate; α-chloroacrylates; vinyl ethers such as methyl vinyl ether, ethyl vinyl ether, benzyl vinyl ether and cyclohexyl vinyl ether; vinyl esters such as vinyl acetate, vinyl propionate, and vinyl benzoate; vinyl ketones such as ethyl vinyl ketone, and cyclohexyl vinyl ketone; styrenes such as styrene, methylstyrene, chlorostyrene and divinylbebzene; amides such as acrylamide, methacrylamide, dimethylacrylamide, diethylacrylamide, n-, i- dipropylacrylamide, and n-, i- or t-butylacrylamide; and chloroolefines such as vinyl chloride and vinylidene chloride.

In the water-soluble polymer, at least 50% of the constituent monomers is needed to be accounted for by a hydrophilic monomer to provide water-solubility to the polymer. Examples of the hydrophilic monomer include the foregoing 2-oxazoline group containing monomers and other monomers such as 2-hydroxyethyl acrylate, methoxy polyethyle glycol acrylate, 2-aminoethylacrylate and their salts salt; acrylamide, N-methylol acrylamide, N-(2-hydroxyethyl)-acrylamide, acrylonitrile, 2-hydroxyethyl methacrylate, methoxy polyethylene glycol methacrylate, aminoethyl methacrylate and their salts; methacrylamideN-methylol methacrylamide, N-(2-hydroxyethyl)-methacrylamide, methacrylamide, methacrylonitrile and sodium styrene sulfonate.

Exemplary examples thereof are shown below but are not limited to these:

W-1: 2-isopropenyl-2-oxazoline,

W-2: 2-vinyl-2-oxazoline/ethyl acrylate (70/30),

W-3: 2-isopropenyl-2-oxazoline/2-hydroxyethyl methacrylate/n-butyl methacrylate (60/20/20), W-4: 2-vinyl-5-methyl-oxazoline/acrylamide (80/20), where numerals in parentheses represent molar ratio. Commercially available water-soluble polymers are also usable, including Epocross WS-500 and WS-300 (which are available from NIPPON SHOKUBAI CO., LTD.).

As an oxazoline group-containing polymer, water-dispersible polymers are preferably used similarly to the water-soluble polymer. The water-dispersible polymer is a water-dispersible polymer containing 2-oxazoline group, as represented by the foregoing formula (A) and exemplary examples thereof include polymer (B) described in JP-A No. 2-99537. Synthesis thereof can be achieved using the foregoing monomer containing 2-oxazoline group and optionally at least one of other kinds of monomers described above by the commonly known emulsion polymerization method or the emulsion polymerization method forming core/shell structure. The amount of the 2-oxazoline group containing monomer to be use is not specifically limited and the 2-oxazoline group containing monomer preferably accounts for at least 3%, and more preferably 5% to 100% by weight of the constituent monomers. The synthesis can be carried out, for example, in accordance with the method described in W. R. Sorenson & T. W. Cambell (translated by T. Hoshino & N. Yoda) "Polymer Synthesis Experiment" on page 144 and 152 (published by KAGAKU DOHJIN) The emulsion polymerization forming a core/shell structure can be accomplished, for example, by the method described in JP-A No. 8-286301.

Exemplary examples thereof are shown below but are not limited to these:

P-1: 2-isopropenyl-2-oxazoline/styrene/ethyl acrylate (30/40/30),

P-2: 2-vinyl-2-oxazoline/methyl methacrylate/cyclohexyl methacrylate (40/40/20), P-3: 2-isopropenyl-4-methyl-2-oxazoline/n-butyl acrylate/styrene (30/35/35), P-4: 2-isopropenyl-2-oxazoline/n-butyl acrylate/styrene/divinylbenzene (30/30/30/10), P-5: poly(2-vinyl-2-oxazoline-co-vinyl acetate-co-styrene) (30:30:40), P-6: poly(2-vinyl-4-methyl-oxazoline-co-styrene-co-ethyl methacrylate) (30:40:30), P-7: poly(2-isopropenyl-oxazoline-co-methy methacrylate-co-ethylene glycol diacrylate( (40:55:5), P-8: (core) poly(vinyl acetate-co-styrene)/(shell) poly(2-isopropenyl-oxazoline-co-methyl methacrylate-co-benzyl acrylate) (40:60)/(35:40:25), P-9: poly[2-(2'-acryloyloxyethyl-oxazoline)-co-methyl methacrylate] (25:75), where numerals in parentheses represent molar ratio. Commercially available water-dispersible polymers are also usable, including Epocross K-1010E, K-1020E, K-1030E, K-2010E, K-2020E and K-2030E (all of which are available from NIPPON SHOKUBAI CO., LTD.).

In one preferred embodiment of the invention, the surface of the sublayer provided on at least one side of the support has a coefficient of friction ($\mu$k, hereinafter, also denoted simply as friction coefficient) of not more than 0.2. A friction coefficient ($\mu$k) of more than 0.2 results in abrasion marks during roll transformation and after being subjected to processing. In the invention, the friction coefficient is preferably not more than 0.2, and more preferably 0.2 to 0.05. It is preferred to incorporate inorganic particles into the sublayer to achieve a friction coefficient of not more than 0.2. The average size pf the inorganic particles is usually 0.1 to 10 $\mu$m, preferably 0.5 to 7 $\mu$m, and more preferably 1 to 5 $\mu$m. Inorganic particles usable in the invention are water-insoluble and are ones commonly known in the art. Examples thereof include silica, titanium dioxide, magnesium dioxide, aluminum oxide, barium sulfate and calcium carbonate, and of these is specifically preferred silica. The content of the inorganic particles is preferably 0.1 to 50 mg/m$^2$, and more preferably 1 to 10 mg/m$^2$.

In one preferred embodiment-of the invention, the second sublayer provided on the support contains a binder exhibiting not less than 5° C. of a difference in peak value of tan 6 obtained in viscoelasticity measurement between at temperature-increasing and temperature-decreasing times. In cases when the difference in peak values of tan $\delta$ at temperature-increasing and temperature decreasing times was less than 5° C., abrasion marks were observed, which occurred during roll transportation and after being processed. There was also a tendency that the light-sensitive layer side surface of a subbed sample easily adhered to the backing layer provided on the opposite side of the support (i.e., deteriorated blocking resistance). Thus it is preferred to use a binder exhibiting at least 5° C. (and more preferably 5 to 20° C.) of the difference in peak values of tan a obtained in the viscoelasticity measurement at temperature-increasing and temperature-decreasing times. Representative examples of the binder exhibiting at least 5° C. of the difference in peak values of tan $\delta$ obtained at temperature-increasing and temperature-decreasing times include polyvinyl alcohol, high density polyethylene, polyethylene terephthalate, polyethylene naphthalate and liquid crystal polymers.

In one preferred embodiment of the invention, the second sublayer provided on at least one side of the support contains at least one selected from a polyvinyl alcohol exhibiting a saponification degree of at least 96% and a polymer having a vinyl alcohol unit exhibiting a saponification degree of at least 96%. The saponification degree is more preferably 96% to 100%. The use of at least one selected from a polyvinyl alcohol exhibiting a saponification degree of at least 96% and a polymer a having a vinyl alcohol unit exhibiting a saponification degree of at least 96% leads to improvements not only in abrasion marks produced in roll transportation and processing but also in blocking resistance.

In one preferred embodiment of the invention, the second sublayer provided on at least one side of the support contains a poly(ethylene-co-vinyl alcohol) exhibiting a saponification degree of at least 96%, and more preferably 96% to 100%. The use of a poly(ethylene-co-vinyl alcohol) exhibiting a saponification degree of at least 96% leads to improvements not only in abrasion marks produced in roll transportation and processing but also in blocking resistance.

Examples of the polymer having a vinyl alcohol unit exhibiting at least 96% saponification degree include polyvinyl alcohol derivatives such as copolymer of ethylene and vinyl alcohol, i.e., poly(ethylene)-co-(vinyl alcohol) and a water-soluble modified polyvinyl alcohol partially having a butyral structure. As a polyvinyl alcohol is preferred one having a polymerization degree of at least 100. Examples of a polymer having a vinyl alcohol unit include polymers having a monomer unit, as a copolymerizing component of a vinyl acetate type polymer prior to saponification, such as a vinyl compound (e.g., ethylene, propylene), acrylic acid esters (e.g., t-butyl acrylate, phenyl acrylate, 2-naphthyl acrylate), methacrylic acid esters (e.g., methyl methacrylate, ethyl methacrylate, 2-hydroxyethyl methacrylate, benzyl methacrylate, 2-hydroxypropyl methacrylate, phenyl methacrylate, cyclohexyl methacrylate, cresyl methacrylate, 40chlorobenzyl methacrylate, ethylene glycol methacrylate), acrylamides (e.g., acrylamide, methylacrylamide, ethylacrylamide, propylacrylamide, butyl-acrylamide, t-butylacrylamide, cyclohexylacrylamide, benzyl-acrylamide, hydroxymethylacrylamide, methoxyethylacrylamide, dimethylaminoethylacrylamide, phenylacrylamide, dimethyl-acrylamide, diethylacrylamide, β-cyanoethylacrylamide, diacetine acrylamide), methacrylamides (e.g., methacrylamide, methylmethacrylamide, ethylmethacrylamide, propylmethacrylamide, butylmethacrylamide, t-butylmethacrylamide, cyclohexylmethacrylamide, benzylmethacrylmethacrylamide, hydroxymethylmethacrylanide, methoxyethylacrylamide, dimethylaminoethylmethacrylamide, phenylmethacrylamide, dimethylmethacrylamide, diethylmethacrylamide, β-cyanoethylmethacrylamide), styrenes (e.g., styrene, methylstyrene, dimethylstyrene, trimethylene styrene, ethylstyrene, isopropylstyrene, chlorostyrene, methoxystyrene, acetoxystyrene, dichlorostyrene, bromstyrene, methyl vinylbenzoate), divinylbenzene, acrylnitrile, methacrylnitrile, N-vinylpyrrolidone, N-vinyloxazolidone, vinilidene chloride, and phenyl vinyl ketone. Of these is preferred poly(ethylene)-co-(vinyl alcohol). These polymers may be used alone or in combination of a plurality thereof, or may be used together with other polymers or water-dispersible polymers such as water-soluble ionic polymers or latexes.

In the invention, it is preferred that the sublayer provided on at least one side of the support contains at least one selected from a polyvinyl alcohol and a polymer having a vinyl alcohol unit, and a polymer soluble in methyl ethyl ketone. The use of such a sublayer containing at least one selected from a polyvinyl alcohol and a polymer having a vinyl alcohol unit, and a polymer soluble in methyl ethyl ketone led to improvements in abrasion marks produced in roll transportation and processing and blocking resistance. Examples of said at least one selected from a polyvinyl alcohol and a polymer having a vinyl alcohol unit include the same ones as mentioned earlier. Examples of a polymer soluble in methyl ethyl ketone include polyethylene, poly (methyl acrylate), poly(methyl methacrylate), poly-N-1,1-dimethyl-3-oxobutylacrylamide, polyisobuthoxyethylene, poly(vinyl butyral), poly(vinyl chloride), poly(vinyl acetate), poly-4-chlorostyrene, polydimethylsiloxane and their copolymers, such as copolymer latex solution (30% solids) comprised of butylacrylate (10 wt %), t-butylacrylate (35 wt %), styrene (27 wt %) and hydroxyethyl acrylate (28 wt %) and copolymer of butyl acrylate (28 wt %), t-butyl acrylate (22 wt %), styrene (25 wt %) and 2-hydroxyethyl acrylate (25 wt %). The polymer soluble in methyl ethyl ketone is incorporated preferably in an amount of 1 to 50% by weight, and more preferably 5 to 30% by weight to achieve an intended effect.

In the invention, it is preferred that the sublayer provided on at least one side of the support contains at least one selected from a polyvinyl alcohol and a polymer having a vinyl alcohol unit, and a polymer having a glycidyl group. The use of such a sublayer containing at least one selected from a polyvinyl alcohol and a polymer having a vinyl alcohol unit, and a polymer having a glycidyl group led to improvements in abrasion marks produced in roll transportation and processing and blocking resistance. Examples of said at least one selected from a polyvinyl alcohol and a polymer having a vinyl alcohol unit include the same ones as mentioned earlier. Examples of a monomer having a glycidyl group include glycidyl acrylate and glycidyl methacrylate. The polymer having glycidyl group preferably contains a glycidyl group component of 10 to 60% as a monomer. This polymer is used preferably in a water-dispersible latex. Examples thereof include a copolymer latex solution (30% solids) comprised of butyl acrylate (40 wt %), styrene (30 wt %) and glycidyl methacrylate (30 wt %); and copolymer latex solution (30% solids) comprised of butyl acrylate (10 wt %), styrene (40 wt %) and glycidyl methacrylate (50 wt %). The polymer having glycidyl group is incorporated preferably in an amount of 1 to 50% by weight, and more preferably 5 to 30% by weight to achieve an intended effect.

In the invention, it is preferred that the sublayer provided on at least one side of the support contains a polyvinyl alcohol or a polymer having a vinyl alcohol unit, and a matting agent relating to the invention. The combined use of at least one selected from a polyvinyl alcohol and a polymer having a vinyl alcohol unit, and a matting agent relating to the invention led to improvements in abrasion marks produced in roll transportation and processing and blocking resistance. Examples of said at least one selected from a polyvinyl alcohol and a polymer having a vinyl alcohol unit include the same ones as mentioned earlier.

Figure 2:
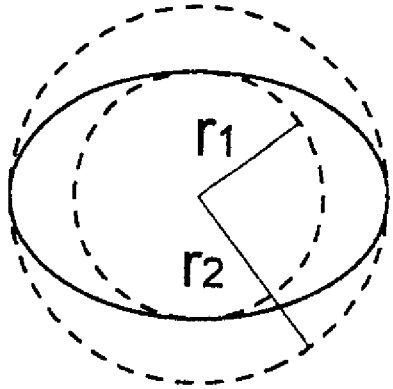
FIG. 2 is a magnified view illustrating a particle form of a matting agent used in the invention and circumscribing and inscribing circles thereof.

FIG. 2 is a magnified view illustrating a form of a matting agent particle used in the invention, and circles circumscribing and inscribing the particle. A matting agent used in the invention preferably has a particle form close to a sphere. As shown in FIG. 1, a ratio of circumscribing circle radius ($r_2$) to inscribing circle radius ($r_1$), i.e., $r_2/r_1$ is preferably within a range of 1 to 1.4, and more preferably 1 to 1.25; and an average primary particle size is preferably 0.01 to 1.6 μm, more preferably 0.03 to 1.6 μm, and still more preferably 0.1 to 1.6 μm. The ratio of $r_2/r_1$ can be determined in such a manner that matting agent particles are electron-microscopically magnified to an extent of some ten thousands power and from obtained electron micrographic images, a inscribing circle having a minimum radius and a circumscribing circle having a maximum radius are drawn to determine the inscribing circle radius ($r_1$) and the circumscribing circle radius ($r_2$). Such a matting agent having a ratio $r_2/r_1$ of 1 to 1.4 can be used without any limitation regarding preparation process, material quality and form. In the invention, the average primary particle size can be determined by measuring sizes of 500 particles of a matting agent in electron micrographs. The use of a matting agent having such a particle form and an average particle size resulted in no formation of abnormal protrusion on the sublayer surface, as observed in the use if conventional matting agents, leading to prevention abrasion marks and dropping-out.

The foregoing matting agent used in the invention may be inorganic particles or fine organic polymer particles, and are preferably those which cause no deformation in thermal development at a temperature of 80 to 140° C. and inorganic particles are more preferred. Matting agents of inorganic particles include those having an inorganic compound structure, as described in "KAGAKU-DAIJITEN" (ENCYCLOPAEDIA CHIMICA) vol. 9, page 312 (1968, compact 4th edition, published by KYORITSU-SHUPPAN). Examples thereof include $CaCO_3CaSO_4$, ZnS, $BaSO_4$, $MgCO_3$, $CaF_2$, ZnO, $ZnCO_3$, $TiO_2$, $SnO_2$, $SiO_2$, $Al_2O_3$ and their complex metal compounds. With regard to $SiO_2$, for example, ethyl ortho-silicate $[Si(Oc_2H_5)_4]$ is hydrolyzed to silica hydrate $[Si(OH)_4]$ to form monodisperse spherical particles. The thus obtained monodisperse silica hydrate particles are subjected to a dehydration treatment to cause three-dimensional growth of silica bonding to prepare a silica matting agent. In the invention, a silica matting agent is preferred.

The matting agent used in the invention is preferably comprised of inorganic particles, the surface of which is modified with an alkoxide. Accordingly, inorganic particles, which have been surface-treated with alcohol are usable. The inorganic particles, the surface of which is modified with an alkoxide are formed in the manner that synthesis in water and alcohol is completed or interrupted when reaching a prescribe particle size during the synthesis, followed by a drying process at a temperature of ca. 300° C. Alternatively, alcohol is added after forming inorganic particles, followed by being treated at ca. 300° C. Such a matting agent usable in the invention is comprised of inorganic particles which have been formed through the wet process, so that alcohol remains on the surface of the thus formed matting agent. Commercially available matting agents include, for example, Sifoster KE-P50, KE-P20, KE-P30, KE-40, KE-50, KE-P70, KE-80, KE-90, KE-P100 and KE-P150 (all of which are available from NIPPON SHOKUBAI CO., LTD). Furthermore, C-foster KE-E20, KE-E30, KE-E40, KE-E50, KE-E70, KE-E80, KE-E90, and KE-E150 (all of which are available from NIPPON SHOKUBAI CO., LTD.) are also cited. Examples of alcohol include methanol, ethanol propanol, butanol, amyl alcohol, benzyl alcohol and ethylene glycol. Of these, methanol and ethanol are preferred and methanol is more preferred.

In the invention, it is preferred that the sublayer provided on at least one side of the support, after being coated and dried, is thermally treated at a temperature higher than a thermal development temperature. The temperature higher than a thermal development temperature is variable depending of an instrument and apparatus to be used and means, and preferably 105 to 200° C., more preferably 110 to 200° C. and still more preferably 110 to 140° C. The thermal treatment time is preferably 1 to 30 min., more preferably 2 to 20 min., and still more preferably 3 to 15 min. As a sublayer to be coated are preferred the sublayers described earlier.

In the invention, it is preferred that the support provided with the foregoing sublayer that has been thermally treated at a temperature higher than a thermal development temperature after coated on at least one side of the support and dried is wound up in an environment at a relative humidity (also denoted simply as RH) of not more than 45%. Winding-up in an environment at a relative humidity (RH) of more than 45% reduces an improvement effect in blocking resistance. The relative humidity of 45 to 20% is more preferred. Herein, the temperature higher than a thermal development temperature is the same as defined earlier. As the sublayer to be coated is employed any one described earlier.

In the invention, it is preferred that a lower sublayer is coated on at least one side of the support and dried, and without winding up the support, a upper sublayer is successively coated on the lower sublayer and dried to form the sublayer. The lower sublayer preferably contains an acryl copolymer. The acryl copolymer preferably contains at least 20 mol % of an alkylacrylate or alkyl methacrylate. A copolymerizing component is selected from styrene, styrene derivatives, olefin derivatives, halogenated ethylene derivatives, vinyl ester derivatives and acrylonitrile. A water-dispersible, 10 to 25 wt % acryl type copolymer latex is specifically preferred. The lower sublayer preferably contains a polymer having an oxazoline group. Examples of the polymer having an oxazoline group include the same as described earlier.

In one preferred embodiment of the invention, the foregoing lower sublayer is coated on a web-form support and dried and further thereon, the sublayer described earlier is coated.

In another preferred embodiment of the invention, the sublayer is coated on at least one side of the support relating to the invention and dried, and after subjected to a thermal treatment at a temperature higher than a thermal development temperature, the sublayer is subjected to a corona discharge treatment. The corona discharge is conducted at 5 to 30 $W/m^2$. The support provided with a sublayer having been subjected to a corona treatment is coated with a light-sensitive layer or a backing layer, preferably within 1 to 2 months after subjected to the corona treatment. The temperature higher than a thermal development temperature is variable, depending of an instrument, apparatus and means to be used, and preferably 105 to 200° C., more preferably 110 to 200° C., and still more preferably 110 to 140° C. The thermal treatment is preferably 1 to 30 min., more preferably 2 to 20 min., and still more preferably 3 to 15 min. The sublayer to be coated may be any one described earlier.

There will be further described techniques commonly applicable to the sublayer described earlier.

An organic solvent which is miscible in an optimum amount of water may be added to a sublayer coating solution. To enhance coatability, surfactants may be added to the sublayer coating solution. Furthermore, a swelling agent for a support, an anti-crossover dye, an antihalation dye, a pigment, an antifoggant, a plasticizer, a cross-linking agent, and a dye may optionally be added to the sublayer coating solution. Examples of the swelling agent include phenol, resorcin, cresol, and chlorophenol. The swelling agent is added in an amount of 1 to 10 g per liter of a sublayer coating solution.

The sublayer coating solution can be coated by commonly known coating methods. The coating methods include, for example, dip coating, air-knife coating, curtain coating, roller coating, wire-bar coating, gravure coating, and extrusion coating using a hopper, as described in U.S. Pat. No. 2,681,294. Two or more layers may be simultaneously coated, as described in U.S. Pat. Nos. 2,761,7913,508,947, 2,941,898 and 3,526,528; Yuji Harasaki, Coating Engineering, page 253 (1973, published by Asakura-Shoten).

The thus coated sublayer is dried preferably at 120 to 200° C. for a period of 10 sec to 10 min. A solid coverage of the sublayer is 0.01 to 10 g/m$^2$, and preferably 0.05 to 3 g/m$^2$.

EXAMPLES

The present invention will be further described based on examples but is not limited to these.

Example 1

Preparation of Subbed Photographic Support

A blue (0.170 density, measured by densitometer PDA-65, available from Konica Corp.) biaxially stretched and thermally fixed, 175 μm thick poly(ethylene terephthalate) film support, both sides of which were subjected to a corona discharge treatment at 8 W/m$^2$ was sub-coated. Thus, on one side of the support, the following sub-coating solution a-1 was coated so as to have a dry layer thickness of 0.2 μm and dried at 115° C. to form a sublayer on the light-sensitive layer (denoted as sublayer A-1). On the opposite side of the support, the following sub-coating solution b-2 was coated so as to have a dry layer thickness of 0.3 μm and dried at 115° C. to form a sublayer having an antistatic function (denoted as conductive sublayer B-2). The surface of sublayer A-1 was subjected to corona discharge at 8 W/m$^2$ and further thereon, the following upper sub-coating solution a-2 was coated so as to have a dry layer thickness of 0.1 μm and dried at 115° C. to form an upper sublayer (denoted as upper sublayer A-2).

Subsequently, the thus sub-coated support was subjected to a thermal treatment at 115° C. for 2 min. to obtain a subbed support sample 1-1. Further, subbed support samples 1-2 through 1-15 were prepared similarly to sample 1-1, provided that metal oxides and inorganic particles shown in Table 1 were used as constituents of the conductive sublayer B-2.

| Sub-coating solution a-1 | |
|---|---|
| L-2 | 70 g |
| Surfactant (A) | 0.3 g |
| Aqueous dispersion of ethoxy-alcohol and ethylene homopolymer | 5.0 g |
| Distilled water to make | 1000 ml |

| Sub-coating solution b-2 | |
|---|---|
| Aqueous modified polyester L-4 solution (18 wt %) | 215 g |
| Metal oxide, in an amount shown in Table 1 | |
| Inorganic particles, in an amount shown in Table 1 | |
| Surfactant (A) | 0.4 g |
| Distilled water to make | 1000 ml |

| Upper sub-coating solution a-2 | |
|---|---|
| Polyvinyl alcohol L-5 (5 wt %) | 250 g |
| Surfactant (A) | 0.4 g |
| Inorganic particle M-3 | 0.3 g |
| Distilled water to make | 1000 ml |
| Surfactant (A) | |

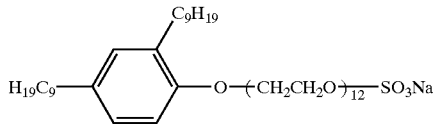

Compounds described in Tables 1 through 10 are as follows:

Metal oxide

F-1: $SnO_2$ sol (10% solid), synthesized according to the method described in JP-A 10-5F-2: $SnO_2$(Sb)/$TiO_2$ 0.2 μm*, T-1, available from Mitsubishi Material Co., Ltd.

F-3: $SnO_2$(Sb) SN100D, available from ISHIHARA SANGYO KAISHA, LTD. (30% solid)

Inorganic particles

M-1: silica 0.04 μm*, TT-600, available from Nippon Airozil Co.

M-2: silica 13 μm*, Silicadole 30G-100, available from NIHON KAGAKU KOGYO CO., LTD.

M-3: Silica 2.2 μm*, TR-3, available from Fuji Davidson Co.

M-4: spherical silica matting agent C-foster KE-P30, available from NIPPON SHOKUBAI CO., LTD.

M-5: spherical silica matting agent C-foster KE-P50, available from NIPPON SHOKUBAI CO., LTD.

Binder

L-1: water-dispersible polyester (15% solid)

L-2: acryl copolymer latex (30% solid) butyl acrylate (10 wt %)/t-butyl acrylate (35 wt %)/styrene (27 wt %)/2-hydroxyethyl acrylate (28 wt %)

L-3: latex of a polymer having an oxazoline group (10% solid), Epocross K-2020E, available from NIPPON SHOKUBAI CO. LTD.

L-4: acryl-modified copolyester (10% solid)

L-5: PVA-613, available from KURARAY CO., LTD. aqueous dispersion (10% solid)

L-6: PVA-617, available from KURABAY CO., LTD. aqueous dispersion (10% solid)

L-7: PVA-110, available from KURARAY CO., LTD. aqueous dispersion (10% solid)

L-8: PVA-117, available from KURARAY CO., LTD. aqueous dispersion (10% solid)

L-9: RS-105, available from KURARAY CO., LTD. aqueous dispersion (10% solid)

L-10: RS-2117, available from KURARAY CO., LTD. aqueous dispersion (10% solid)

L-11: RS-617, available from KURARAY CO., LTD. aqueous dispersion (10% solid)

Preparation of Aqueous Polyester L-1 Solution

Using 35.4 weight parts of dimethyl terephthalate, 33.63 weight parts of dimethyl isophthalate, 17.92 weight parts of dimethyl 5-sulfoisophthalate sodium salt, 62 weight parts of ethylene glycol, 0.065 weight parts of calcium acetate, and 0.022 weight parts of manganese acetate tetrahydrate, trans-esterification was carried out at 170 to 220° C. under nitrogen gas stream, while distilling away methanol. Thereafter, 0.04 weight parts of trimethyl phosphate, 0.04 weight parts of antimony trioxide as a polycondensation catalyst and 6.8 weight parts of 1,4-cyclohexane-dicarboxylic acid were added thereto and esterification was performed at 220 to 235° C. with removing a theoretical amount of water. The pressure within the reaction system was reduced and the temperature was raised in 1 hr. and polycondensation was carried out at a pressure of 133 Pa and a temperature of 280° C. over a period of 1 hr. to obtain a water-dispersible polyester A-1. The thus obtained aqueous polyester A-1 exhibited an intrinsic viscosity of 0.33.

Subsequently, to 2 liter three-necked flask provided with a stirring blade, reflux condenser and thermometer was added 850 ml of water and then, 150 g of aqueous polyester A-1 was gradually added thereto, while stirring with the stirring blade. After stirred further for 30 min. at room temperature, the reaction mixture was heated in 1.5 hr. so as to reach 98° C. and heating was further continued at this temperature for 3 hr. After completion of heating, the reaction mixture was cooled to room temperature in 1 hr. and alloed to stand over a night to prepare an aqueous polyester L-1 solution (15% solid).

Preparation of Aqueous Modified Polyester L-4 Solution

To 3 liter four-necked flask provided with a stirring blade, reflux condenser, thermometer and dropping funnel was added 1900 ml of aqueous 15 wt % polyester L-1 solution and the internal temperature was raised 80° C., while stirring with the stirring blade. Further thereto was added 6.52 ml of an aqueous 24% ammonium peroxide solution and a monomer mixture solution (35.7 g of ethyl acrylate and 35.7 g of methyl methacrylate) was dropwise added for 30 min. and the reaction was further continued for 3 hr. Thereafter, the reaction mixture was cooled to a temperature of 30° C. or lower and filtered to obtain aqueous modified polyester L-4 (18 wt % solid).

Formation of Backing Layer

On the conductive sublayer (B-2) of subbed support sample 1-1, the following backing layer coating solution was coated so as to have a dry layer thickness of 3.5 μm, using an extrusion coater and dried by hot air at a dry bulb temperature of 100° C. and a dew point of 10° C. in 5 min. to form a backing layer.

Preparation of Backing Layer Coating Solution

To 830 g of methyl ethyl ketone (MEK), 84.2 g of cellulose acetate butyrate (CAB381-20, available from Eastman Chemical Co.) and 4.5 g of polyester resin (Vitel PE2200B, available from Bostic Corp.) were added with stirring and dissolved therein. To the resulting solution was added 0.30 g of infrared dye-1, then, 4.5 g fluorinated surfactant [Surflon S-381 (active ingredients of 70%) available from ASAHI Glass Co. Ltd.] and 2.3 g fluorinated surfactant (Megafac F120K, available from DAINIPPON INK Co. Ltd.) which were dissolved in 43.2 g methanol, were added thereto and stirred until being dissolved. Then, 75 g of silica (Siloid 64×6000, available from W. R. Grace Corp.), which was dispersed in methyl ethyl ketone in a concentration of 1 wt % using a dissolver type homogenizer, was added with stirring to obtain a coating solution for the backing layer.

Infrared dye-1

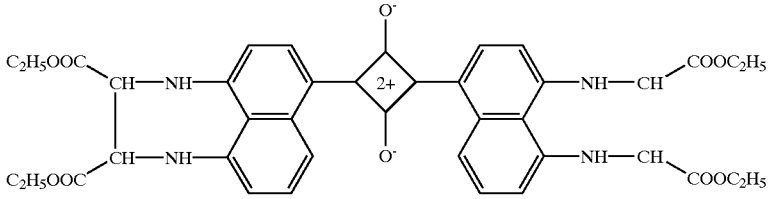

Layer Formation of Light-sensitive Layer Side

On upper sublayer A-2 of the light-sensitive layer side of the foregoing subbed support, the following light-sensitive layer coating solution and a protective layer coating solution were simultaneously coated using an extrusion coater to prepare a silver salt photothermographic imaging material. Coating was carried out so that silver coverage of the light-sensitive layer was 1.9 g/m$^2$ and a dry thickness of the protective layer was 2.5 μm. Drying was conducted for 10 min. using hot air at a dry bulb temperature of 75° C. and a dew point of 10° C. to obtain silver salt photothermographic material sample 1-1.

| Preparation of Light-Sensitive Silver Halide Emulsion A | |
|---|---|
| Solution A1 | |
| Phenylcarbamoyl gelatin | 88.3 g |
| Compound A* (10% methanol solution) | 10 ml |
| Potassium bromide | 0.32 g |
| Water to make | 5429 ml |
| Solution B1 | |
| 0.67 mol/l Aqueous silver nitrate solution | 2635 ml |
| Solution C1 | |
| Potassium bromide | 51.55 g |
| Potassium iodide | 1.47 g |
| Water to make | 660 ml |
| Solution D1 | |
| Potassium bromide | 154.9 g |
| Potassium iodide | 4.41 g |
| Iridium chloride (1% solution) | 0.93 ml |
| Water to make | 1982 ml |
| Solution E1 | |
| 0.4 mol/l aqueous potassium bromide solution | Amount necessary to adjust silver potential |
| Solution F1 | |
| Potassium hydroxide | 0.71 g |
| Water to make | 20 ml |
| Solution G1 | |
| Aqueous 56% acetic acid solution | 18 ml |
| Solution H1 | |
| Anhydrous sodium carbonate | 1.72 g |
| Compound (A) $HO(CH_2CH_2O)_n$-$(CH(CH_3)CH_2O)_{17}$-$(CH_2CH_2O)_mH$ (m + n = 5 to 7) | |

Using a stirring mixer described in JP-B 58-58288, 1/4 of solution B1, the total amount of solution C1 were added to solution A1 by the double jet addition for 4 min 45 sec. to form nucleus grain, while maintaining a temperature of 45° C. and a pAg of 8.09. After 1 min., the total amount of solution F1 was added thereto. After 6 min, ¾ of solution B1 and the total amount of solution D1 were further added by the double jet addition for 14 min 15 sec., while mainlining a temperature of 45° C. and a pAg of 8.09. After stirring for 5 min., the reaction mixture was lowered to 40° C. and solution G1 was added thereto to coagulate the resulting silver halide emulsion. Remaining 2000 ml of precipitates, the supernatant was removed and after adding 10 lit. water with stirring, the silver halide emulsion was again coagulated. Remaining 1500 ml of precipitates, the supernatant was removed and after adding 10 lit. water with stirring, the silver halide emulsion was again coagulated. Remaining 1500 ml of precipitates, the supernatant was removed and solution H1 was added. The temperature was raised to 60° C. and stirring continued for 120 min. Finally, the pH was adjusted to 5.8 and water was added there to so that the weight per mol of silver was 1161 g, and light-sensitive silver halide emulsion A was thus obtained.

It was proved that the resulting emulsion was comprised of monodisperse silver iodobromide cubic grains having an average grain size of 0.058 μm, a coefficient of variation of grain size of 12% and a [100] face ratio of 92%.

Preparation of Powdery Organic Silver Salt A

Behenic acid of 130.8 g, arachidic acid of 67.7 g, stearic acid of 43.6 g and palmitic acid of 2.3 g were dissolved in 4720 ml of water at 90° C. Then, 540.2 ml of aqueous 1.4 mol/l NaOH was added, and after further adding 6.9 ml of concentrated nitric acid, the mixture was cooled to 55° C. to obtain a fatty acid sodium salt solution. To the thus obtained fatty acid sodium salt solution, 45.3 g of light-sensitive silver halide emulsion B-3 obtained above and 450 ml of water were added and stirred for 5 min., while being maintained at 55° C. Subsequently, 760 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 μS/cm. Using a flush jet dryer (produced by Seishin Kigyo Co., Ltd.), the thus obtained cake-like organic silver salt was dried under an atmosphere of inert gas (i.e., nitrogen gas) having a volume ratio shown in Table 1, according to the operation condition of a hot air temperature at the inlet of the dryer until reached a moisture content of 0.1%. The moisture content was measured by an infrared ray aquameter.

Preparation of Pre-dispersion A

In 1457 g MEK was dissolved 14.57 g of polyvinyl butyral powder (B-79, available from Monsanto Co.) and further thereto was gradually added 500 g of powdery organic silver salt 1A to obtain pre-dispersion, while stirring by a dissolver type homogenizer (DISPERMAT Type CA-40, available from VMA-GETZMANN).

Preparation of Light-sensitive Emulsion 1

Thereafter, using a pump, the thus prepared pre-dispersion was transferred to a media type dispersion machine (DISPERMAT Type SL-C12 EX, available from VMA-GETZMANN), which was packed 1 mm Zirconia beads (TORESELAM, available from Toray Co. Ltd.) by 80%, and dispersed at a circumferential speed of 8 m/s and for 1.5 min. of a retention time with a mill to obtain light-sensitive emulsion 1A.

Preparation of Stabilizer Solution

In 4.97 g of methanol were dissolved 1.0 g of Stabilizer 1 and 0.31 g of potassium acetate to obtain stabilizer solution.

Preparation of Infrared Sensitizing Dye Solution A

In 31.3 ml of MEK were dissolved 19.2 mg of infrared sensitizing dye SD-1, 1.488 g of 2-chlorobenzoic acid, 2.779 g of Stability 2 and 365 mg of 5-methyl-2-mercaptobensimidazole in a dark room to obtain an infrared sensitizing dye solution 1A.

Preperation of Addition Solution A

In 110 g MEK were dissolved developer 27.98 g of 1,1-bis(2-hydroxy-3,5-dimethylphinyl)-2-methylpropane, 1.54 g of 4-methylaphthalic acid and 0.48 g of the infrared dye 1 to obtained additive solution a.

Preperation of Additive Solution B

Antifoggant-2 of 1.56 g and 3.43 g of phthalazinone were dissolved in 40.9 g of MEK to to make additive solution b.

Stabilizer 1

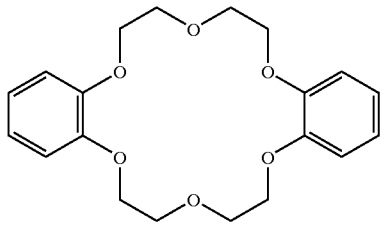

SD-1

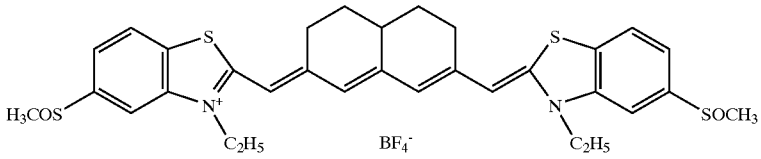

-continued

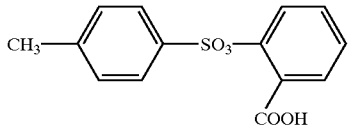

Stabilize-2

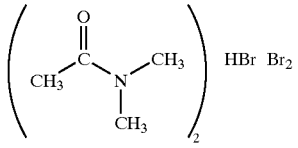

Antifoggant-2

Preparation of Light-sensitive Layer Coating Solution A

Under inert gas atmosphere (97% nitrogen), 50 g of the light-sensitive emulsion 1 and 15.11 g MEK were maintained at 21° C. with stirring, 1000 μl of chemical sensitizer S-5 (0.5% methanol solution) was added thereto and after 2 min., 390 μm of antifoggant-1 (10% methanol solution) was added and stirred for 1 hr. Further thereto, 494 μl of calcium bromide (10% methanol solution) was added and after stirring for 10 min., gold sensitizer Au-5 of 1/20 equimolar amount of the chemical sensitizer was added and stirred for 20 min. Subsequently, 167 ml of the stabilizer solution was added and after stirring for 10 min., 1.32 g of the infrared sensitizing dye solution A described above was added and stirred for 1 hr. Then, the mixture was cooled to 13° C. and stirred for 30 min. Further thereto, polyvinyl butyral (Butvar B-79, available from Monsanto Co.) was added and stirred for 30 min, while maintaining the temperature at 13° C. and 1.084 g of tetrachlorophthalic acid (9.4% MEK solution) and stirred for 15 min. Then, 12.43 g of additive solution a, 1.6 ml of 10% MEK solution of Desmodur N3300 (aliphatic isocyanate, product by Movey Co.) and 4.27 g of additive solution b were successively added with stirring to obtain coating solution A of the light-sensitive layer.

S-5

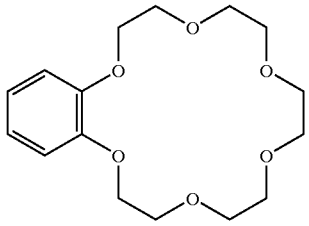

Au-5

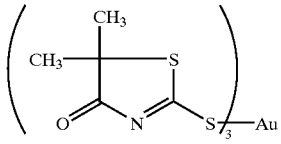

Antifoggant-1

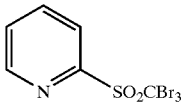

Preparation of Matting Agent Dispersion

In 42.5 g of methyl ethyl ketone was dissolved 7.5 g of cellulose acetate-butyrate (CAB171-15, available from Eastman Chemical Co.) and then 5 g of calcium carbonate (Super-Pflex 200, available from Speciality Mineral Corp.) was added thereto and dispersed using a dissolver type homogenizer at a speed of 800 rpm over a period of 30 min. to obtain calcium carbonate dispersion.

Preparation of Coating Solution for Protective Layer

To 865 g of methyl ethyl ketone were added with stirring 96 g of cellulose acetate-butyrate (CAB171-15, available from Eastman Chemical Co.) and 4.5 g of polymethyl methacrylate (Paraloid A-21, available from Rohm & Haas Corp.). Further thereto were added and dissolved 1.5 g of vinylsulfon compound HD-1, 1.0 g of benzotriazole and 1.0 g of fluorinated surfactant (Surflon KH40, available from ASAHI Glass Co. Ltd.). Finally, 30 g of the foregoing matting agent dispersion was added and stirred to obtain a coating composition for the surface protective layer.

Vinylsulfon compound HD-1: $(CH_2{=}CHSO_2CH_2)_2CHOH$

As described above, a backing layer, light-sensitive layer and protective layer were provided on the subbed support sample 1-1 to prepare silver salt photothermographic material sample 1-1. Photothermographic material samples 1-2 through 1-15 were prepared similarly the foregoing photothermographic material sample 1-1, except that the subbed support sample 1-1 was replaced by subbed support sample 1-2 through 1-15, respectively.

The thus prepared samples were evaluated in accordance with the procedure described below.

Maximum Height ($R_y$) of Surface

The backing layer side of each of the subbed support samples was measured with respect to maximum height ($R_y$) according to the method based on JIS B0601-1994.

Abrasion Mark in Roll Transportation

Subbed support samples were each cut to 1 m in a longitudinal direction and set in a transportation apparatus provided with three rolls so as to go an around of 1 mm so that the backing layer side of the sample was brought into contact with the rolls. The rolls, which were wounded with flockpaper, were rotated at a rate 30 m/min for 300 min., while applying a load of 5 N/cm onto the rolls. The thus transported samples were observed within an area of 5 cm×5 cm by a microscope and the number of abrasion marks caused in transportation were counted.

Blocking Resistance

The light-sensitive layer side of each of the subbed support samples was brought into contact with the backing layer side thereof and a load of $1.5\times10^4$ Pa was applied thereto. After one month, the sample was peeled apart and visually evaluated based on the following criteria:

A: no blocking was observed,

B: a sound was heard but no transfer was observed,

C: at least 20% of the sublayer on the light-sensitive layer side or backing layer side was transferred.

Abrasion Mark after Processing

Photothermographic material samples were thermally processed at 120° C. for 15 sec. using an automatic thermal processor provided with a heat drum so that the protective layer of each sample was brought into contact with the drum surface. Exposure and processing were carried out in a room maintained at 23° C. and 50% RH. The backing layer side of each of the processed samples was evaluated in an atmosphere of 23° C. and 50% RH with respect to abrasion mark in accordance to the method based on JIS K5400-1990, wherein a hand-scratching method of JIS K5400-1990 8.4.2. was employed. Pencil hardness was represented by density marks 5B, 4B, 3B, 2B, B,F, HB, H, 2H, 3H, 4H and 5H, of which the 5B was the softest and the 5H was the hardest.

Evaluation of Surface Resistivity

After allowed to stand in an atmosphere of 23° C. and 55% RH for 24 hr., the backing layer side of each of the photothermographic material samples was measure with respect to surface resistivity using Tera Ohmmeter Model VE-30, vailable from KAWAGUCHI Electric Co., Ltd. The observed value was represented in unit of Ω·cm. Designation was represented by log Ω.

TABLE 1

| | Conductive Sublayer (B-2) | | | | Abrasion | | | Surface | |
|---|---|---|---|---|---|---|---|---|---|
| Sample No. | Metal Oxide (vol %) | Inorganic Particle (mg/m²) | Maximum Height (μm) | Mark in Roll Transportation (number) | Blocking Resistance | Abrasion Mark after Processing | Resistivity log Ω (Ω · cm) | Remark |
| 1-1 | F-1 0 | — — | 0.06 | 60 | C | H | 12.8 | Comp. |
| 1-2 | F-1 3 | — — | 0.07 | 0 | C | H | 12.4 | Comp. |
| 1-3 | F-1 5 | — — | 0.07 | 0 | A | 2H | 11.7 | Inv. |
| 1-4 | F-1 20 | — — | 0.07 | 0 | A | 2H | 10.9 | Inv. |
| 1-5 | F-1 35 | — — | 0.08 | 0 | A | 2H | 10.5 | Inv. |
| 1-6 | F-1 45 | — — | 0.09 | 0 | A | 2H | 10.1 | Inv. |
| 1-7 | F-1 60 | — — | 0.09 | 150 | A | H | 10 | Comp. |
| 1-8 | F-2 5 | — — | 0.18 | 80 | A | F | 11.4 | Comp. |
| 1-9 | F-2 35 | — — | 0.19 | 170 | A | F | 11.1 | Comp. |
| 1-10 | F-1 5 | M-1 10 | 0.07 | 0 | A | 2H | 12.6 | Inv. |
| 1-11 | F-1 35 | M-1 10 | 0.08 | 0 | A | 2H | 10.4 | Inv. |
| 1-12 | F-1 5 | M-2 10 | 0.12 | 60 | A | F | 12.4 | Comp. |
| 1-13 | F-1 35 | M-2 10 | 0.13 | 80 | A | F | 10.5 | Comp. |
| 1-14 | F-1 5 | M-3 10 | 2.2 | more than 300 | A | HB | 124 | Comp. |
| 1-15 | F-1 35 | M-3 10 | 2.3 | more than 300 | A | HB | 10.5 | Comp. |

As is apparent from Table 1, support samples having a sublayer according to the invention were superior in resistance to abrasion mark in roll transportation and blocking resistance, and the photothermographic material samples by the use thereof exhibited superior resistance to abrasion mark after processing, as compared to comparative samples.

Example 2

Preparation of Subbed Photographic Support

A blue (0.170 density, measured by densitometer PDA-65, available from Konica Corp.) biaxially stretched and thermally fixed, 175 μm thick poly(ethylene terephthalate) film support, both sides of which were subjected to a corona discharge treatment at 8 W/m² was sub-coated. Thus, on one side of the support, the sublayer coating solution a-1 was coated so as to have a dry layer thickness of 0.2 μm and dried at 115° C. to form a sublayer on the light-sensitive layer (denoted as sublayer A-1). On the opposite side of the support, the following sub-coating solution b-1 was coated so as to have a dry layer thickness of 0.12 μm and dried at 115° C. to form a sublayer of the backing layer side (denoted as conductive sublayer B-1). Surfaces of sublayer A-1 and sublayer B-1 were each subjected to corona discharge at 8 W/m². Similarly to Example 1, the upper sub-coating solution a-2 was coated on sublayer A-1 so as to have a dry layer thickness of 0.1 μm and dried at 115° C. to form an upper sublayer (denoted as upper sublayer A-2). Furthermore, sublayer coating solution b-2 used in Example 1 was coated on sublayer B-1 so as to have a dry layer thickness of 0.3 μm and dried to form a sublayer on the backing layer side (denoted as conductive sublayer B-2). Thereafter, the thus prepared subbed support sample was further subjected to a thermal treatment at 115° C. for 2 min. to obtain subbed support sample 2-1.

Subbed support sample 2-2 through 2-15 were prepared similarly to the foregoing subbed support sample 2-1, except that the metal oxide and inorganic particles contained in the conductive sublayer (B-2) were varied as shown in Table 2 and sublayer B-1 provided as a sublayer lower to the conductive sublayer was also varied as shown in Table 2.

| Sublayer coating solution b-1 | |
|---|---|
| Water-dispersible polyester L-1 (18 wt %) | 95 g |
| Surfactant (A) | 0.6 g |
| Distilled water to make | 1000 ml |

Similarly to Example 1, a backing layer, light-sensitive layer and protective layer were provided using subbed support sample 2-1 to prepared photothermographic material sample 2-1. Similarly to photothermographic material sample 2-1, photogthermagraphic material sample 2-2 through 2-15 were prepared using subbed support sample 2-2 through 2-15, respectively. Thus obtained samples were evaluated similarly to Example 1.

TABLE 2

| Sample No. | Conductive Sublayer (B-2) Metal Oxide (vol %) | Inorganic Particle (mg/m$^2$) | Maximum Height (μm) | Sub-layer (B-1) Binder | Abrasion Mark in Roll Transportation (number) | Blocking Resistance | Surface Abrasion Mark after Processing | Resistivity log Ω (Ω · cm) | Remark |
|---|---|---|---|---|---|---|---|---|---|
| 1-1 | F-1 0 | — — | 0.06 | — | 80 | C | H | 12.8 | Comp. |
| 2-1 | F-1 0 | — — | 0.06 | L-1 | 75 | C | H | 12.8 | Comp. |
| 2-2 | F-1 0 | — — | 0.06 | L-2 | 75 | C | H | 12.8 | Comp. |
| 2-3 | F-1 0 | — — | 0.06 | L-3 | 75 | C | H | 12.8 | Comp. |
| 1-4 | F-1 20 | — — | 0.07 | — | 0 | A | 2H | 10.9 | Inv. |
| 2-4 | F-1 20 | — — | 0.07 | L-1 | 0 | A | 2H | 10.9 | Inv. |
| 2-5 | F-1 20 | — — | 0.07 | L-2 | 0 | A | 3H | 10.9 | Inv. |
| 2-6 | F-1 20 | — — | 0.07 | L-3 | 0 | A | 4H | 10.9 | Inv. |
| 1-7 | F-1 60 | — — | 0.09 | — | 150 | A | H | 10 | Comp. |
| 2-7 | F-1 60 | — — | 0.09 | L-1 | 140 | A | H | 10 | Comp. |
| 2-8 | F-1 60 | — — | 0.09 | L-2 | 120 | A | H | 10 | Comp. |
| 2-9 | F-1 60 | — — | 0.09 | L-3 | 110 | A | H | 10 | Comp. |
| 1-9 | F-2 35 | — — | 0.19 | — | 170 | A | F | 11.1 | Comp. |
| 2-10 | F-2 35 | — — | 0.19 | L-1 | 170 | A | F | 11.1 | Comp. |
| 2-11 | F-2 35 | — — | 0.19 | L-2 | 150 | A | F | 11.1 | Comp. |
| 2-12 | F-2 35 | — — | 0.19 | L-3 | 150 | A | F | 11.1 | Comp. |
| 1-15 | F-1 35 | M-3 10 | 2.3 | — | more than 300 | A | HB | 10.5 | Comp. |
| 2-13 | F-1 35 | M-3 10 | 2.3 | L-1 | more than 300 | A | HB | 10.5 | Comp. |
| 2-14 | F-1 35 | M-3 10 | 2.3 | L-2 | more than 300 | A | HB | 10.5 | Comp. |
| 2-15 | F-1 35 | M-3 10 | 2.3 | L-3 | more than 300 | A | HB | 10.5 | Comp. |

As is apparent from Table 2, subbed support samples according to the invention were superior in resistance to abrasion mark in roll transportation and blocking resistance, and the photothermographic material samples by the use thereof exhibited superior resistance to abrasion mark after processing, as compared to comparative samples. It is further noted that providing a lower sublayer (B-1) containing an acryl copolymer or a water-soluble polymer containing an oxazoline group led to further improved results.

Example 3

Preparation of Subbed Photographic Support

A blue (0.170 density, measured by densitometer PDA-65, available from Konica Corp.) biaxially stretched and thermally fixed, 175 μm thick poly(ethylene terephthalate) film support, both sides of which were subjected to a corona discharge treatment at 8 W/m$^2$ was sub-coated. Thus, on one side of the support, the following sub-coating solution a-1 was coated so as to have a dry layer thickness of 0.2 μm and dried at 115° C. to form a sublayer on the light-sensitive layer (denoted as sublayer A-1). On the opposite side of the support, the following sub-coating solution b-1 was coated so as to have a dry layer thickness of 0.1 μm and dried at 115° C. to form a conductive sublayer having an antistatic function (denoted as conductive sublayer B-1). Surfaces of sublayer A-1 and conductive sublayer B-1 were each subjected to corona discharge at 8 W/m$^2$. The following upper sublayer coating solution a-2 was coated on sublayer A-1 so as to have a dry layer thickness of 0.1 μm and dried at 115° C. to form an upper sublayer (denoted as upper sublayer A-2) Furthermore, the following sublayer coating solution b-2 was coated on conductive sublayer B-1 so as to have a dry layer thickness of 0.2 μm and dried at 115° C. to form a upper sublayer B-2. Thereafter, the thus prepared subbed support sample was further subjected to a thermal treatment at 115° C. for 2 min. to obtain a subbed support sample 3-1.

Subbed support sample 3-2 through 3-7 were prepared similarly to the foregoing subbed support sample 3-1, except that the metal oxide and inorganic particles contained in the conductive sublayer (B-2) were varied as shown in Table 3.

| Sublayer coating solution b-1 | |
|---|---|
| Styrene (20 wt %)/glycidyl acrylate (40 wt %) copolymer latex solution (30% solids) | 13 g |
| Butyl acrylate (30 wt %)/t-butyl acrylate (20 wt %)/styrene (25 wt %)/2-hydroxyethyl acrylate (25 wt %) copolymer latex (30% solids) | 3 g |
| $SnO_2$ sol (10% solid) | 86 g |
| Surfactant (A) | 0.4 g |
| Distilled water to make | 1000 ml |

| Upper sublayer coating solution a-2 | |
|---|---|
| RS-613 (PVA, available from Kuraray Co., Ltd.) 5 wt % solution | 500 g |
| Surfactant (A) | 0.4 g |
| Inorganic particles M-3 | 0.3 g |
| Distilled water to make | 1000 ml |

| Upper sublayer coating solution b-2 | |
|---|---|
| Modified aqueous polyester L-4 Solution (18 wt %) | 215 g |
| Metal oxide F-1 (as shown in Table 1) | 0 g |
| Inorganic particles M-3 | 0.3 g |
| Surfactant (A) | 0.4 g |
| Distilled water to make | 1000 ml |

Similarly to Example 1, a backing layer, light-sensitive layer and protective layer were provided on the subbed support sample 3-1 to prepare silver salt photothermographic material sample 3-1. Photothermographic material samples 3-2 through 3-7 were prepared similarly the foregoing photothermographic material sample 3-1, except that the subbed support sample 3-1 was replaced by subbed support sample 3-2 through 3-7, respectively. Evaluation thereof was made similarly to Example 1. A friction coefficient was measured with respect to the sublayer of the backing layer side of respective subbed support samples, in accordance with the method based on JIS K7125-1987.

TABLE 3

| Sample No. | Conductive Sublayer (B-2) Inorganic Particle (mg/m$^2$) | Friction Coefficient ($\mu$k) | Abrasion Mark in Roll Transportation (number) | Blocking Resistance | Abrasion Mark after Processing | Surface Resistivity log Ω (Ω·cm) |
|---|---|---|---|---|---|---|
| 3-1 | — | 0.62 | 102 | C | H | 10.7 |
| 3-2 | M-4 (2) | 0.18 | 0 | A | 2H | 10.7 |
| 3-3 | M-4 (10) | 0.17 | 0 | A | 2H | 10.7 |
| 3-4 | M-5 (2) | 0.2 | 0 | A | 2H | 10.7 |
| 3-5 | M-5 (10) | 0.18 | 0 | A | 2H | 10.7 |
| 3-6 | M-3 (2) | 0.35 | 150 | A | H | 10.7 |
| 3-7 | M-3 (10) | 0.25 | 140 | A | F | 10.7 |

Example 4

Subbed support samples 4-1 through 4-9 were prepared similarly to Example 3, provided that upper sublayer A-2 of the light-sensitive layer side was varied as shown in Table 4. Similarly to Example 3, photothermographic material samples 4-1 through 4-9 were prepared using these subbed support samples.

Difference of Tan δ

Viscoelasticity measurements were carried in the following manner to determine the difference in peak value of tan δ. between at the time of temperature rise and at the time of temperature drop.

Viscoelesticity Measurement

Using an apparatus for measuring viscoelasticity of solid, RSA-II (available from Rheometric Co.), a tensile viscoelasticity measurement was carried out according to the following conditions to determine E' (storage elasticity), E" (loss elasticity) and tan δ.

Sample: 5 mm width×35 mm length

Applied frequency: 100 rad/sec

Applied strain: 0.0001 (0.01%)

Measuring temperature: 0 to 140° C.

Measuring interval: 5° C. (soaking time =30 sec.)

Similarly to Example 1, samples were also evaluated with respect to abrasion mark, blocking resistance, abrasion mark after processing and surface resistivity.

TABLE 4

| Sample No. | Upper Sublayer (A-2) Binder | Difference in tan δ (° C.) | Inorganic Particle (mg/m$^2$) | Abrasion Mark in Roll Transportation (number) | Blocking Resistance | Abrasion Mark after Processing | Surface Reisitivity log Ω (Ω·cm) |
|---|---|---|---|---|---|---|---|
| 4-1 | L-4 | 5 | — | 125 | C | F | 10.7 |
| 4-2 | L-4 | 5 | M-3 (2) | 140 | B | F | 10.7 |
| 4-3 | L-1 | 0 | M-3 (2) | 160 | B | F | 10.7 |
| 4-4 | L-2 | 2 | M-3 (2) | 180 | B | F | 10.7 |
| 4-5 | L-3 | 5 | M-3 (2) | 175 | B | F | 10.7 |
| 4-6 | L-5 | 20 | — | 40 | A-B | H | 10.7 |
| 4-7 | L-5 | 20 | M-3 (2) | 50 | A | H | 10.7 |
| 4-8 | L-6 | 25 | — | 45 | A-B | H | 10.7 |
| 4-9 | L-6 | 25 | M-3 (2) | 53 | A | H | 10.7 |

Example 5

Subbed support samples 5-1 through 5-4 were prepared similarly to Example 3, provided that upper sublayer A-2 of the light-sensitive layer side was varied as shown in Table 5. Similarly to Example 3, photothermographic material samples 5-1 through 5-4 were prepared using these subbed support samples.

TABLE 5

| Sample No. | Upper Sublayer (A-2) Binder (%*) | Upper Sublayer (A-2) Inorganic Particle (mg/m$^2$) | Abrasion Mark in Roll Transportation (number) | Blocking Resistance | Abrasion Mark after Processing | Surface Resistivity log Ω (Ω·cm) |
|---|---|---|---|---|---|---|
| 4-6 | L-5 (92.5-94.5) | — | 40 | A-B | H | 10.7 |
| 4-7 | L-5 (92.5-94.5) | M-3 (2) | 50 | A | H | 10.7 |
| 4-8 | L-6 (94.5-95.5) | — | 45 | A-B | H | 10.7 |
| 4-9 | L-6 (94.5-95.5) | M-3 (2) | 53 | A | H | 10.7 |
| 5-1 | L-7 (98.0-99.0) | — | 10 | A-B | 2H | 10.7 |
| 5-2 | L-7 (98.0-99.0) | M-3 (2) | 20 | A | H | 10.7 |
| 5-3 | L-8 (98.0-99.0) | — | 15 | A-B | 2H | 10.7 |
| 5-4 | L-8 (98.0-99.0) | M-3 (2) | 23 | A | H | 10.7 |

*saponification degree (%)

Example 6

Subbed support samples 6-1 through 6-6 were prepared similarly to Example 3, provided that upper sublayer A-2 of the light-sensitive layer side was varied as shown in Table 6. Similarly to Example 3, photothermographic material samples 6-1 through 6-6 were also prepared using these subbed support samples.

TABLE 6

| Sample No. | Upper Sublayer (A-2) Binder (%*) | Upper Sublayer (A-2) Inorganic Particle (mg/m$^2$) | Abrasion Mark in Roll Transportation (number) | Blocking Resistance | Abrasion Mark after Processing |
|---|---|---|---|---|---|
| 5-1 | L-7 (98.0-99.0) | — | 10 | A-B | 2H |
| 5-2 | L-7 (98.0-99.0) | M-3 (2) | 20 | A | H |
| 5-3 | L-8 (98.0-99.0) | — | 15 | A-B | 2H |
| 5-4 | L-8 (98.0-99.0) | M-3 (2) | 23 | A | H |
| 6-1 | L-9 (97.0-99.0) | — | 0 | A | 2H |
| 6-2 | L-9 (97.0-99.0) | M-3 (2) | 0 | A | 2H |
| 6-3 | L-10 (97.0-99.0) | — | 0 | A | 2H |
| 6-4 | L-10 (97.0-99.0) | M-3 (2) | 0 | A | 2H |

TABLE 6-continued

| Sample No. | Upper Sublayer (A-2) Binder (%*) | Upper Sublayer (A-2) Inorganic Particle (mg/m$^2$) | Abrasion Mark in Roll Transportation (number) | Blocking Resistance | Abrasion Mark after Processing |
|---|---|---|---|---|---|
| 6-5 | L-11 (94.5-95.5) | | 11 | A | 2H |
| 6-6 | L-11 (94.5-95.5) | | 14 | A | H |

*saponification degree (%)

As is apparent from Table 6, subbed support samples relating to the invention were superior in resistance to abrasion mark in roll transportation and blocking resistance in the sublayer of the backing layer side, and the photothermographic material samples by the use thereof exhibited superior resistance to abrasion mark after processing, as compared to comparative samples.

Example 7

Subbed support samples 7-1 through 7-9 were prepared similarly to Example 3, provided that upper sublayer A-2 of the light-sensitive layer side was varied as shown in Table 7. Similarly to Example 3, photothermographic material samples 7-1 through 7-9 were also prepared using these subbed support samples. Samples were similarly evaluated.

Polymer latexes used in this Example, which were soluble in methyl ethyl ketone were as follows:

A: butyl acrylate (10 wt %)/t-butyl acrylate (35 wt %)/styrene (27 wt %)/2-hydroxyethyl acrylate (28 wt %) copolymer latex solution (30% solids);

B: butyl acrylate (28 wt %)/t-butyl acrylate (22 wt %)/styrene (25 wt %)/2-hydroxyethyl acrylate (25 wt %) copolymer latex solution;

C: ethyl acrylate (95 wt %)/methyl methacrylate (5 wt %) copolymer latex solution.

The polymer latex was added in an amount shown in Table 7 (represented by wt %, based on the total amount of binder and polymer latex). In Examples 8, 9 and 10, the same definition was applied.

TABLE 7

| Sample No. | Upper Sublayer (A-2) Binder (%*) | | Polymer Latex (wt %) | Inorganic Particle (mg/m$^2$) | Abrasion Mark in Roll Transportation (number) | Blocking Resistance | Abrasion Mark after Processing | Surface Resistivity log Ω (Ω · cm) |
|---|---|---|---|---|---|---|---|---|
| 6-3 | L-10 | (97.0–99.0) | — | — | 0 | A | 2H | 10.7 |
| 6-4 | L-10 | (97.0–99.0) | — | M-3 (2) | 0 | A | 2H | 10.7 |
| 7-1 | L-10 | (97.0–99.0) | A (10) | — | 0 | A | 3H | 10.7 |
| 7-2 | L-10 | (97.0–99.0) | A (10) | M-3 (2) | 0 | A | 3H | 10.7 |
| 7-3 | L-10 | (97.0–99.0) | A (20) | M-3 (2) | 0 | A | 3H | 10.7 |
| 4-4 | L-5 | (92.5–94.5) | — | — | 40 | A–B | H | 10.7 |
| 4-5 | L-5 | (92.5–94.5) | — | M-3 (2) | 50 | A | H | 10.7 |
| 7-4 | L-5 | (92.5–94.5) | A (0) | — | 20 | A–B | 2H | 10.7 |
| 7-5 | L-5 | (92.5–94.5) | A (10) | M-3 (2) | 25 | A | 2H | 10 7 |
| 7-6 | L-5 | (92.5–94.5) | A (20) | M-3 (2) | 20 | A | 2H | 10.7 |
| 7-7 | L-5 | (92.5–94.5) | B (20) | M-3 (2) | 22 | A | 2H | 10.7 |
| 7-8 | L-5 | (92.5–94.5) | C (20) | — | 40 | A–B | H | 10.7 |
| 7-9 | L-5 | (92.5–94.5) | C (20) | M-3 (2) | 51 | A | H | 10.7 |

*saponification degree (%)

Example 8

Subbed support samples 8-1 through 8-9 were prepared similarly to Example 3, provided that upper sublayer A-2 of the light-sensitive layer side was varied as shown in Table 8. Similarly to Examples 3, photoethermographic material samples 8-1 through 8-9 were also prepared using these subbed support samples. Samples were similarly evaluated.

Polymer latexes used in Example 8 were as follows:

D: butyl acrylate (40 wt %)/styrene (30 wt %)/glycidyl methacrylate (30 wt %) copolymer latex solution (30% solids);

E: butyl acrylate (10 wt %)/styrene (40 wt %)/glycidyl acrylate (50 wt %) copolymer latex solution (30% solids);

F: butyl acrylate (40 wt %)/t-butyl acrylate (30 wt %)/styrene (30 wt %) copolymer latex solution (30% solids).

TABLE 8

| Sample No. | Upper Sublayer (A-2) Binder (%*) | | Polymer Latex (wt %) | Inorganic Particle (mg/m$^2$) | Abrasion Mark in Roll Transportation (number) | Blocking Resistance | Abrasion Mark after Processing | Surface Resistivity log Ω (Ω · cm) |
|---|---|---|---|---|---|---|---|---|
| 6-3 | L-10 | (97.0–99.0) | — | — | 0 | A | 2H | 10.7 |
| 6-4 | L-10 | (97.0–99.0) | — | M-3 (2) | 0 | A | 2H | 10.7 |
| 8-1 | L-10 | (97.0–99.0) | D (10) | — | 0 | A | 3H | 10.7 |
| 8-2 | L-10 | (97.0–99.0) | D (10) | M-3 (2) | 0 | A | 3H | 10.7 |
| 8-3 | L-10 | (97.0–99.0) | D (20) | M-3 (2) | 0 | A | 4H | 10.7 |
| 4-4 | L-5 | (92.5–94.5) | — | — | 40 | A–B | H | 10.7 |
| 4-5 | L-5 | (92.5–94.5) | — | M-3 (2) | 50 | A | H | 10.7 |
| 8-4 | L-5 | (92.5–94.5) | D (0) | — | 20 | A–B | 2H | 10.7 |
| 8-5 | L-5 | (92.5–94.5) | D (10) | M-3 (2) | 25 | A | 2H | 10.7 |
| 8-6 | L-5 | (92.5–94.5) | D (20) | M-3 (2) | 20 | A | 2H | 10.7 |
| 8-7 | L-5 | (92.5–94.5) | E (20) | M-3 (2) | 12 | A | 3H | 10.7 |
| 8-8 | L-5 | (92.5–94.5) | F (20) | — | 40 | A–B | H | 10.7 |
| 8-9 | L-5 | (92.5–94.5) | F (20) | M-3 (2) | 51 | A | H | 10.7 |

*saponification degree (%)

Subbed support samples 9-1 through 9-9 were prepared similarly to Example 3, provided that upper sublayer A-2 of the light-sensitive layer side was varied as shown in Table 9. Similarly to Example 3, photothermographic material samples 9-1 through 9-9 were also prepared using these subbed support samples. Samples were similarly evaluated.

TABLE 9

| Sample No. | Upper Sublayer (A-2) Binder | Polymer Latex (wt %) | Matting Agent (mg/m$^2$) | Abrasion Mark in Roll Transportation (number) | Blocking Resistance | Abrasion Mark after Processing | Surface Resistivity log Ω (Ω· cm) |
|---|---|---|---|---|---|---|---|
| 4-6 | L-5 | — | — | 40 | A–B | H | 10.7 |
| 4-7 | L-5 | — | M-3 (2) | 50 | A | H | 10.7 |
| 9-1 | L-5 | — | M-4 (2) | 20 | A | 2H | 10.7 |
| 9-2 | L-5 | — | M-5 (2) | 0 | A | 2H | 10.7 |
| 9-3 | L-5 | — | M-5 (5) | 0 | A | 2H | 10.7 |
| 4-1 | L-4 | — | — | 125 | C | F | 10.7 |
| 4-2 | L-4 | — | M-3 (2) | 140 | B | F | 10.7 |
| 9-4 | L-4 | — | M-5 (2) | 40 | A | H | 10.7 |
| 6-3 | L-10 | — | — | 0 | A | 2H | 10.7 |
| 6-4 | L-10 | — | M-3 (2) | 0 | A | 2H | 10.7 |
| 9-5 | L-10 | — | M-5 (2) | 0 | A | 3H | 10.7 |
| 7-1 | L-10 | A (10) | — | 0 | A | 3H | 10.7 |
| 7-2 | L-10 | A (10) | M-3 (2) | 0 | A | 3H | 10.7 |
| 9-6 | L-10 | A (10) | M-5 (2) | 0 | A | 4H | 10.7 |
| 7-5 | L-5 | A (10) | M-3 (2) | 25 | A | 2H | 10.7 |
| 9-7 | L-5 | A (10) | M-5 (2) | 0 | A | 3H | 10.7 |
| 8-1 | L-10 | D (10) | | 0 | A | 3H | 10.7 |
| 8-2 | L-10 | D (10) | M-3 (2) | 0 | A | 3H | 10.7 |
| 9-8 | L-10 | D (10) | M-5 (2) | 0 | A | 4H | 10.7 |
| 8-5 | L-5 | D (10) | M-3 (2) | 25 | A | 2H | 10.7 |
| 9-9 | L-5 | D (10) | M-5 (2) | 0 | A | 3H | 10.7 |

*saponification degree (%)

Example 10

Subbed support samples 10-1 through 10-7 were prepared similarly to Example 3, provided that upper sublayer A-2 of the light-sensitive layer side was varied as shown in Table 10, and variation were also made with respect to thermal treatment condition, converting method (i.e., lower and upper sublayers were continuously or successively provided) and corona discharge treatment, as shown in Table 10. Similarly to Example 3, photothermographic material samples 9-1 through 9-9 were also prepared using these subbed support samples. Samples were similarly evaluated.

TABLE 10

| | Upper Sublayer (A-2) | | | Thermal | | | | Abrasion | | | Surface |
|---|---|---|---|---|---|---|---|---|---|---|---|
| Sample No. | Binder (%*) | Polymer Latex (wt %) | Inorganic Particle (mg/m$^2$) | Treatment Temp. (° C.) | Humidity (%) | Converting | Corona Discharge | Mark in Roll Transportation (number) | Blocking Resistance | Abrasion Mark after Processing | Resistivity log Ω (Ω · cm) |
| 6-6 | L-11 | — | M-3 (2) | 115 | 50 | Suc. | — | 14 | A | H | 10.7 |
| 10-2 | L-11 | — | M-3 (2) | 100 | 50 | Suc. | — | 34 | A | F | 10.6 |
| 10-3 | L-11 | — | M-4 (2) | 125 | 50 | Suc. | — | 0 | A | 2H | 10.5 |
| 10-4 | L-11 | — | M-5 (2) | 135 | 50 | Suc. | — | 0 | A | 2H | 10.5 |
| 6-5 | L-11 | — | M-5 (5) | 115 | 50 | Suc. | — | 11 | A | 2H | 10.7 |
| 10-1 | L-11 | — | — | 115 | 43 | Suc. | — | 0 | A | 3H | 10.7 |
| 9-1 | L-5 | — | M-3 (2) | 115 | 50 | Suc. | — | 20 | A | 2H | 10.7 |
| 10-5 | L-5 | — | M-5 (2) | 115 | 50 | Con. | — | 0 | A | 3H | 10.7 |
| 7-5 | L-5 | — | — | 115 | 50 | Suc. | — | 25 | A | 2H | 10.7 |
| 10-6 | L-5 | — | M-3 (2) | 115 | 50 | Suc. | Yes | 0 | A | 3H | 10.7 |
| 8-5 | L-5 | — | M-5 (2) | 115 | 50 | Suc. | — | 25 | A | 2H | 10.7 |
| 10-7 | L-5 | A (10) | — | 135 | 43 | Con. | Yes | 0 | A | 3H | 10.7 |

*saponification degree (%)

What is claimed is:

1. A photothermographic material comprising a support having thereon a light sensitive layer containing an organic silver salt, a light sensitive silver halide, a reducing agent and a binder, wherein the support is provided with a first sublayer on the opposite side of the support to the light sensitive layer, the first sublayer containing a metal oxide in an amount of 5 to 50% by volume based on the volume of the first sublayer and the surface of the first sublayer exhibiting a maximum height of not more than 0.1 mm.

2. The photothermographic material of claim 1, wherein the metal oxide is at least one selected from the group consisting of ZnO, $TiO_2$, $SnO_2$, $Al_2O_3$, $In_2O_3$, $SiO_2$, MgO, $B_2O$ and $MoO_3$.

3. The photothermographic material of claim 1, wherein a lower sublayer is provided between the first sublayer and the support, and the lower sublayer containing an acryl copolymer.

4. The photothermographic material of claim 1, wherein a lower sublayer is provided between the first sublayer and the support, and the lower sublayer containing a polymer having an oxazoline group.

5. The photothermographic material of claim 1, wherein the first sublayer exhibits a coefficient of friction of not more than 0.2.

6. The photothermographic material of claim 1 wherein the first sublayer further contains inorganic particles having an average particle size of 0.1 to 10 μm.

7. The photothermographic material of claim 1, wherein a second sublayer is provided on the opposite side of the support to the first sublayer, and the second sublayer containing a binder exhibiting not less than 5° C. of a difference in peak values of tan δ obtained in viscoelasticity measurement at temperature-increasing and temperature-decreasing times.

8. The photothermographic material of claim 1, wherein a second sublayer is provided on the opposite side of the support to the first sublayer, and the second sublayer containing at least one selected from the group consisting of a polyvinyl alcohol and a polymer having a vinyl alcohol unit, which have a saponification degree of at least 96%.

9. The photothermographic material of claim 8, wherein the second sublayer further contains a polymer soluble in methyl ethyl ketone.

10. The photothermographic material of claim 8, wherein the second sublayer further contains a polymer having a glycidyl group.

11. The photothermographic material of claim 1, wherein a second sublayer is provided on the opposite side of the support to the first sublayer, and the second sublayer containing a poly(ethylene-co-vinyl alcohol) having a saponification degree of at least 96%.

12. A photothermographic material comprising a support having thereon a light sensitive layer containing an organic silver salt, a light sensitive silver halide, a reducing agent and a binder, wherein the support is provided with a first sublayer on the opposite side of the support to the light sensitive layer, the first sublayer containing a metal oxide in an amount of 5 to 50% by volume based on the volume of the first sublayer and the surface of the first sublayer exhibiting a maximum height of not more than 0.1 mm, and wherein a lower sublayer is provided between the first sublayer and the support, and the lower sublayer containing an acryl copolymer.

13. A photothermographic material comprising a support having thereon a light sensitive layer containing an organic silver salt, a light sensitive silver halide, a reducing agent and a binder, wherein the support is provided with a first sublayer on the opposite side of the support to the light sensitive layer, the first sublayer containing a metal oxide in an amount of 5 to 50% by volume based on the volume of the first sublayer and the surface of the first sublayer exhibiting a maximum height of not more than 0.1 mm, and wherein a lower sublayer is provided between the first sublayer and the support, and the lower sublayer containing a polymer having an oxazoline group.

* * * * *